US007641329B2

(12) United States Patent
Akiyama et al.

(10) Patent No.: US 7,641,329 B2
(45) Date of Patent: Jan. 5, 2010

(54) CONVEYANCE CONTROL DEVICE, CONVEYANCE SYSTEM AND IMAGE FORMING SYSTEM

(75) Inventors: Shigeki Akiyama, Nagoya (JP); Mitsuhiro Nozaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 377 days.

(21) Appl. No.: 11/188,724

(22) Filed: Jul. 26, 2005

(65) Prior Publication Data

US 2006/0023051 A1 Feb. 2, 2006

(30) Foreign Application Priority Data

Jul. 27, 2004 (JP) ..... 2004-219204

(51) Int. Cl.
*B41J 2/01* (2006.01)

(52) U.S. Cl. ..... 347/104

(58) Field of Classification Search ..... 347/104, 347/105, 5–19; 355/72; 399/371, 401; 271/24, 271/65, 270
See application file for complete search history.

(56) References Cited

U.S. PATENT DOCUMENTS

2002/0126193 A1* 9/2002 Maki et al. ..... 347/104
2003/0184002 A1 10/2003 Akiyama et al.

FOREIGN PATENT DOCUMENTS

JP 05-069610 A 3/1993
JP 10-067148 A 3/1998
JP 2002-120425 4/2002
JP 2002272187 A 9/2002
JP 2003-291433 10/2003
JP 2004175082 A 6/2004

OTHER PUBLICATIONS

Office Action in corresponding Japanese Application No. 2004-219204.

* cited by examiner

*Primary Examiner*—Stephen D Meier
*Assistant Examiner*—Alexander C Witkowski
(74) *Attorney, Agent, or Firm*—Banner & Witcoff, Ltd

(57) ABSTRACT

The conveyance control device includes a detector that detects the conveyance distance of an object by a conveyance device, a section determiner that determines to which section within an object a reference point of the object belongs, and a target setter, based on a determination result of the section determiner, sets the target conveyance speed corresponding to the section to which the reference point belongs. Based on a detection result of the detector, the operation amount calculation sequentially calculates the operation amount of the conveyance device. The conveyance controller provides a control signal corresponding to the operation amount calculated by the operation amount calculator for the conveyance device and makes the conveyance device convey the object to move a reference point of the object from the conveyance start point to the conveyance destination at a speed corresponding to the target conveyance speed.

9 Claims, 15 Drawing Sheets

FIG.11

| SECTION | FIRST TARGET CONVEYANCE SPEED | SECOND TARGET CONVEYANCE SPEED |
|---|---|---|
| FIRST SECTION | HIGHER | HIGHER |
| SECOND SECTION | LOWER | LOWER |
| THIRD SECTION | HIGHER | LOWER |

CONVEYANCE CONTROL DEVICE, CONVEYANCE SYSTEM AND IMAGE FORMING SYSTEM

CROSS-REFERENCE TO RELATED APPLICATIONS

This application claims the benefit of Japanese Patent Application No. 2004-219204 filed on Jul. 27, 2004 in the Japanese Patent Office, the disclosure of which is incorporated herein by reference.

BACKGROUND

The present invention relates to a conveyance control device for controlling a conveyance device to convey an object so as to move a reference point of the object, positioned at a conveyance start point, along a conveyance path from the conveyance start point to a conveyance destination, located in the downstream of the conveyance path. The present invention also relates to a conveyance system wherein the conveyance control device is used, and to an image forming system that forms an image at the conveyance destination.

Conventionally, an inkjet image forming system is known wherein an image is formed on an image forming medium, such as paper. In this type of image forming system, ink is ejected from a recording head that serves as an image forming device, and an image is formed on an image forming medium based upon image data. Consequently, the above-described system is provided with a mechanism (conveyance device) for conveying an image forming medium, e.g. paper, to an image formation point wherein image formation is conducted by the image forming device, and a conveyance control device.

A conventional conveyance device that conveys an image forming medium (object), such as paper, is provided with pairs of conveyance rollers that respectively rotate on a rotational axis intersecting (at right angle) with the conveyance direction of an object. The conveyance rollers are provided along a conveyance path that guides the movement of an object. In this type of conveyance device, an object is held by the above-described pair of conveyance rollers which are facing each other, the driving force (the frictional force) in the rotational direction of the conveyance rollers is applied thereto and conveyed in the rotational direction by the conveyance rollers being rotated while the object being held therebetween.

Specifically, a conveyance device, provided with pairs of conveyance rollers both in the upstream and the downstream of a conveyance path, is known as the above-described conveyance device. This type of conveyance device conveys an object to an image formation destination with conveyance rollers disposed in the upstream. The conveyance rollers, disposed in the downstream, hold an area of the object wherein an image is formed at the image formation destination, and convey the object toward the discharge side.

SUMMARY

A conveyance control device according to one aspect of the present invention is configured to control a conveyance device that is connected to the conveyance control device. The connected conveyance device is operated according to a control signal inputted from the conveyance control device. The conveyance device applies driving force corresponding the operation amount thereof to an object, and conveys the object along a conveyance path from the upstream to the downstream of the conveyance path.

By providing the control signal for the conveyance device, the conveyance control device makes the conveyance device convey the object to move a reference point of the object, located at a conveyance start point in the conveyance path, to a conveyance destination, that is located more toward the downstream of the conveyance path further than the conveyance start point. It is to be noted that the reference point of an object simply indicates a point on an object located at the conveyance start point, but this does not mean that an object has a structure formed to be indicating this reference point.

The conveyance control device includes a detector that detects the conveyance distance of an object conveyed by the conveyance device, a target setter, an operation amount calculator, a conveyance controller and a section determiner.

The section determiner determines to which section within an object a reference point of the object belongs. The target setter sets a target conveyance speed to convey the object to move the reference point of the object from the conveyance start point to the conveyance destination. The target setter, based on a determination result of the section determiner, sets the target conveyance speed corresponding to the section to which the reference point belongs.

Based on a detection result of the detector, the operation amount calculation sequentially calculates the operation amount of the conveyance device, that is necessary to convey an object to move a reference point of the object from the conveyance start point to the conveyance destination at specific speed corresponding to the target conveyance speed set by the target setter. The conveyance controller provides a control signal corresponding to the operation amount calculated by the operation amount calculator for the conveyance device, and makes the conveyance device convey an object to move a reference point of the object from the conveyance start point to the conveyance destination at a speed corresponding to the target conveyance speed set by the target setter based on the determination result of the section determiner.

BRIEF DESCRIPTION OF THE DRAWINGS

The invention will now be described below, by way of example, with reference to the accompanying drawings.

FIG. 11 is a chart to show an example of settings for the first and second target conveyance speeds in each section;

DETAILED DESCRIPTION OF THE PREFERRED EMBODIMENT

Figure 1:
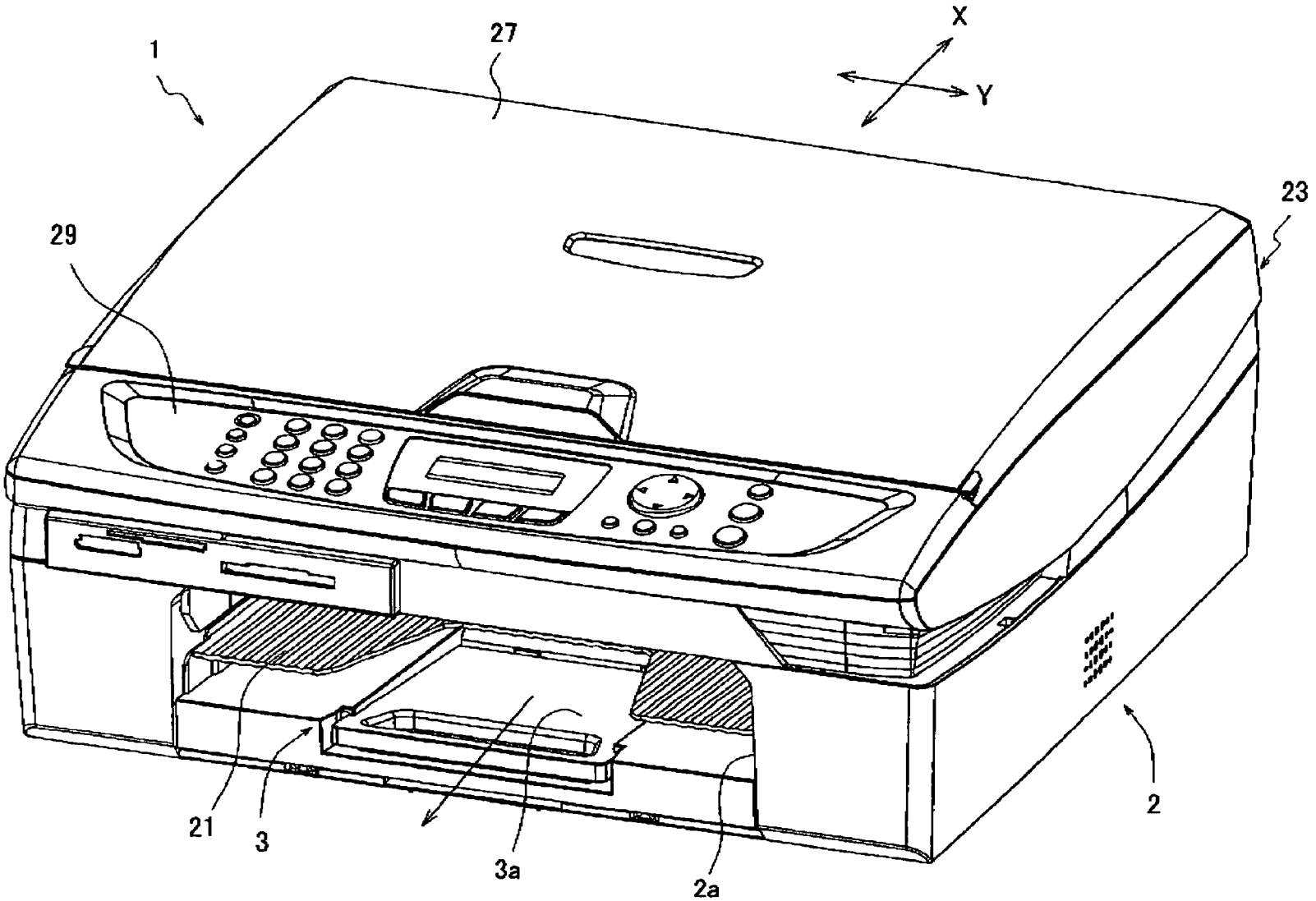
FIG. 1 is a perspective view to show the structure of a Multi Function Device to which the image forming system of an embodiment of the present invention is applied.
Figure 2:
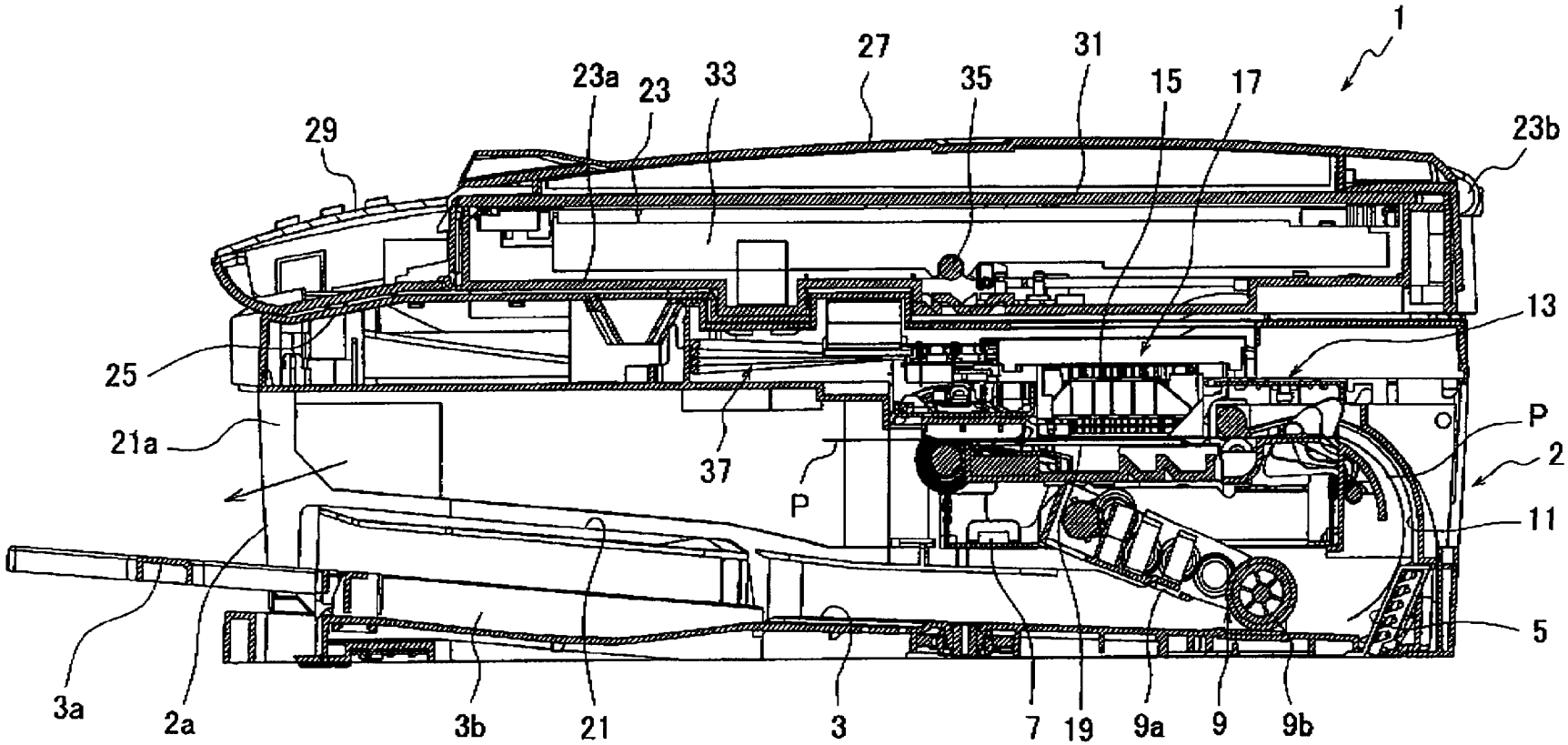
FIG. 2 is a sectional side view of the MFD shown in FIG. 1.

Referring to FIGS. 1 and 2, the MFD (Multi Function Device) 1 of the present embodiment serves as a printer, copier, scanner and facsimile, and comprises, on a bottom of a housing 2 made of synthetic resin, a feed cassette 3, which can be inserted into the housing 2 from an opening 2*a* provided on a front side of the housing 2.

The feed cassette 3 is constituted to be able to store a plurality of paper P, for example, in A4 or legal sizes. The narrow side of each paper P is placed in parallel to a direction (corresponding to a main scanning direction and Y-axis) orthogonal to a paper conveyance direction (corresponding to a sub-scanning direction and the X-axis).

On the front end of the feed cassette 3, a support member 3*a*, movable in the X-axis direction, is attached to support the rear end portion of paper P having a long length (such as in legal-size). FIG. 2 shows an example wherein the support member 3*a* is exteriorly extended from the housing 2. However, the support member 3*a* can be stored into a storage space 3*b* so as to not interrupt the feeding, in which case paper P can fit into the feed cassette 3 (such as for A4 size paper).

On the rear side of the feed cassette 3, a bank 5 is provided to separate the sheets of paper P. On the bottom plate of a box-shaped metal mainframe 7 of the MFD 1, the rear end of a feed arm 9*a* of a feed unit 9 is attached so as to be rotatable in the vertical direction. Paper P stored in the feed cassette 3 in layers are fed separately in a sheet-by-sheet manner by a feed roller 9*b* provided at the bottom end of the feed arm 9*a* and the bank 5. A sheet of paper P, separated as above, is conveyed to an image forming unit 13 disposed above (at a higher position) the feed cassette 3 via a U-turn path 11 constituting a conveyance path in a U shape.

The image forming unit 13 comprises a carriage 17 which carries an inkjet recording head 15 thereto, and can reciprocate in the main scanning direction. The carriage 17 is controlled by CPU 51 that is to be described later, and moves the recording head 15 in the main scanning direction. The recording head 15 ejects ink while scanning and forms an image on stationary paper P, which is placed under the recording head 15. During image formation, paper P is supported from below by a platen 19 constituting a conveyance path. That is, the recording head 15 is located over the platen 19. Image formation on paper P by the recording head 15 is conducted over the platen 19.

Paper P is discharged to a discharge unit 21 after image formation is conducted thereon by the image forming unit 13. The discharge unit 21 is formed on the upper side of the feed cassette 3. A discharge outlet communicating with the discharge unit 21 has an opening that forms one portion of the opening 2*a* on the front surface of the housing 2.

On the housing 2, an image reading device 23 is disposed to be used for reading an original image. A bottom wall 23*a* of this image reading device 23 is disposed overlapping an upper cover 25 almost without any interspace therebetween. The image reading device 23 is turnable around one end of the housing 2 via a pivot (not shown) so as to be opened and closed. The rear end of a cover 27 covering the upper surface of the image reading device 23 is attached to the rear end of the image reading device 23 so as to be vertically turnable around the pivot 23*b*.

In front of the image reading device 23, there is an operation panel unit 29 comprising various operation buttons and a LCD. On the upper surface of the image reading device 23, a glass plate 31 is provided for an original image to be placed thereon when the cover 27 is opened upward. Under the glass plate 31, an image scanner (CIS: Contact Image Sensor) 33 for reading an original image is provided reciprocatably along a guide shaft 35 extending in the main scanning direction (the Y-axis direction).

In the front portion of the housing 2 covered by the imaged reading device 23, an ink storage unit (not shown) is provided to be opened upward, In this ink storage unit, ink cartridges respectively storing one of four colors (black, cyan, magenta and yellow) for full-color printing are removably installed from above. In the MFD 1 of the present embodiment, ink stored in the ink cartridges is supplied to the recording head 15 through a plurality of ink supply tubes 37 connecting respective ink cartridges and the recording head 15.

Figure 3:
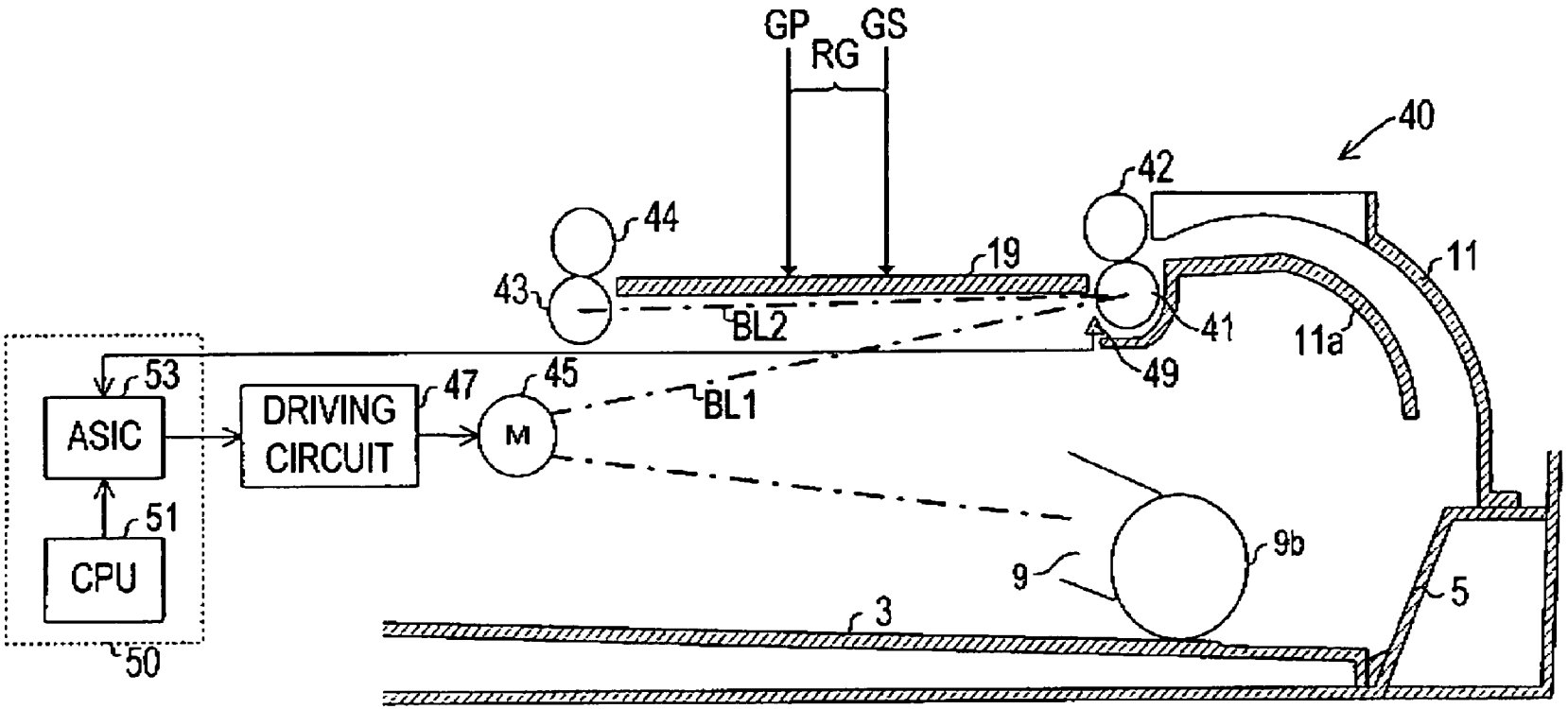
FIG. 3 is an explanatory view to show the structure of a conveyance unit and a conveyance control unit that constitute the conveyance system of the embodiment.

The following describes a paper conveyance system of the MFD 1. FIG. 3 shows schematic structures of a conveyance unit 40 and a conveyance control unit 50 constituting the paper conveyance system of the MFD 1. In the drawing, the units in the MFD 1 that are already described with FIGS. 1 and 2 are diagrammatically illustrated for explaining the paper conveyance. For the same constituents already described in FIGS. 1 and 2, the same reference numerals are given in this drawing.

As shown in FIG. 3, the conveyance unit 40 of the MFD 1 comprises: the feed cassette 3; the feed unit 9 that separates the plurality of paper P stored in the feed cassette 3 in a sheet-by-sheet manner and that individually feeds paper P; a conveyance roller 41 that conveys paper P fed by the feed roller 9*b* of the feed unit 9 toward a location beneath the recording head 15; a pinch roller 42 facing and being pressed against the conveyance roller 41; an discharge roller 43 that assists paper conveyance during image formation and discharges paper P to the discharge unit 21 after image formation; a pinch roller (spur roller) 44 facing and being pressed against the discharge roller 43; the bank 5; the U-turn path 11; the platen 19 constituting a conveyance path of paper P together with the bank 5 and the U-turn path 11; a LF (Line Feed) motor 45 that is the driving source of the conveyance roller 41 and the discharge roller 43; transmission mechanisms BL1 and BL2 that transmit the force generated by the motor 45; and a driving circuit 47 that drives the motor 45 based on various commands (control signals) inputted from the ASIC 53.

The upstream portion of the conveyance path constituted with the bank 5 and the U-turn path 11 limits the movement of paper P fed by the feed roller 9*b*, and guides the paper P to the contact point of the conveyance roller 41 and the pinch roller 42. Under the downstream portion (in regard to the conveyance direction of paper P) of the U-turn path 11, there is an assistant unit 11*a* provided to guide paper P to the contact point of the conveyance roller 41 and the pinch roller 42.

Accordingly, paper P fed from the feed cassette 3 is guided to the contact point between the conveyance roller 41 and the pinch roller 42 by the bank 5, U-turn path 11 and the assistant unit 11*a*. When paper P is guided to the contact point and the conveyance roller 41 makes a regular rotation in regard to the conveyance direction (counterclockwise rotation in FIG. 3), paper P is drawn between the conveyance roller 41 and the pinch roller 42, and held by these rollers. Subsequently, corresponding to the rotation of the conveyance roller 41, paper P is conveyed in the conveyance direction toward the discharge roller 43 for a distance corresponding to the amount of rotation of the conveyance roller 41.

The platen 19 constitutes the downstream portion of the conveyance path connecting the conveyance roller 41 and the discharge roller 43, and is disposed between the conveyance roller 41 and the discharge roller 43 along a line connecting these rollers. The platen 19 guides paper P sent from the conveyance roller 41 to an area wherein an image is formed by the recording head 15, and guides paper P, on which an image is formed, by the recording head 15 to a contact point between the discharge roller 43 and the pinch roller 44. Hereinafter, the end point in the downstream side of an image formation area RG, wherein image formation is conducted with various colors of ink, is referred to as an image formation point GP, and a point in the vicinity of the end point in the upstream side of the image formation area RG is referred to as a conveyance start point GS.

Paper P is conveyed toward the discharge roller 43 along the platen 19. When the leading end (the edge in the downstream side) of paper P reaches the contact point between the discharge roller 43 and the pinch roller 44, corresponding to the rotation of the discharge roller 43, paper P is drawn between the discharge roller 43 and the pinch roller 44 and held by these two rollers. Subsequently, corresponding to the further rotation of the discharge roller 43, paper P is conveyed in the conveyance direction toward the discharge unit 21 for a distance corresponding to the amount of rotation of the discharge roller 43 (the same amount as in the rotation of the conveyance roller 41). The above-described conveyance roller 41, discharge roller 43, pinch rollers 42 and 44, are all rotators respectively having a rotational axis in a direction perpendicular to the conveyance direction (main scanning direction). Paper P receives a driving force generated corresponding to the rotations of the conveyance roller 41 and the discharge roller 43 at the respective contact points with these two rollers. Paper P is conveyed in the conveyance direction along the conveyance path (i.e. from the upstream to downstream of the conveyance path) as described above.

The above-mentioned motor 45 is constituted with a DC motor and is driven by the driving circuit 47. The motor 45 provides rotational force thereof to the conveyance roller 41 via the transmission mechanism BL1 provided between the motor 45 and the conveyance roller 41. Consequently, the conveyance roller 41 is rotated. The rotational force transmitted to the conveyance roller 41 is furthermore transmitted to the discharge roller 43 via the transmission mechanism BL2 provided between the conveyance roller 41 and the discharge roller 43. Thus, the discharge roller 43 is rotated together with the conveyance roller 41 in the same direction. Still furthermore, the rotational force generated from the motor 45 is transmitted to the feed roller 9*b* via a transmission mechanism (not shown) and the feed roller 9*b* is rotated thereby.

However, the feed roller 9*b* rotates in the conveyance direction of paper P only during a feeding process of feeding paper P toward the conveyance roller 41. During an image formation process, the feed roller 9*b* does not receive a rotational force from the motor 45 and therefore is idle. In other words, the transmission mechanism connecting the feed roller 9*b* and the motor 45 only transmits a rotational force to the feed roller 9*b* during the feeding process, but disengages gears installed therein and does not transmit the rotational force to the feed roller 9*b* during the image formation process.

When the feed roller 9*b* is rotated in the conveyance direction, the conveyance roller 41 and the discharge roller 43 are rotated in the opposite direction to the conveyance direction. That is, the transmission mechanism connecting the feed roller 9*b* and the motor 45 does not transmit the rotational force to the feed roller 9*b* when the motor 45 is regularly rotated. When the motor 45 is reversely rotated, the transmission mechanism converts the rotational force into a rotational force in the regular direction by the installed gears, and transmits the converted rotational force to the feed roller 9*b*.

It should be noted that the feed process mentioned herein indicates a process to rotate the feed roller 9*b* while being pressed against the top sheet of paper P layered in the feed cassette 3, and to convey the leading end of paper P to a resist position that is the contact point with the conveyance roller 41 and the pinch roller 42. The image formation process herein indicates a process comprising: an initial conveyance process to convey the leading end of a drawing area of paper P placed at the resist position to the image formation point GP; and a subsequent main process to sequentially convey a reference point of paper P located at the conveyance start point GS to the image formation point GP in every interval corresponding to the width of the image formation area RG in the conveyance direction, and to form an image on paper P by ejecting ink from the recording head 15 in conjunction with the conveyance of paper P. A reference point of paper P indicates a point on paper P located at the conveyance start point GS when conveyance initiated. Hence, a reference point of paper P changes time after time as paper P is conveyed.

The above-described conveyance unit 40 is provided with a rotary encoder 49 that outputs pulse signals every time the conveyance roller 41 rotates through a predetermined amount. Output signals from the rotary encoder 49 are inputted into the ASIC 53 of the conveyance control unit 50. In the present embodiment, the conveyance roller 41 and the discharge roller 43 are rotated by the motor 45, and the rotation of the motor 45 is also transmitted to the feed roller 9*b*. Consequently, in the MFD 1, it is possible to detect the rotational amount of the motor 45, conveyance roller 41, discharge roller 43, and the feed roller 9*b*, and to detect the travel distance (conveyance distance) of paper P conveyed by each roller (41, 43 and 9*b*) by detecting and counting the pulse signals from the encoder 49.

The conveyance control unit 50 connected to the driving circuit 47 of the conveyance unit 40 provides the driving circuit 47 with a command for the motor 45, and controls the rotation of the motor 45 constituting the conveyance unit 40. Additionally, the conveyance control unit 50 indirectly controls paper conveyance with the feed roller 9*b*, conveyance roller 41 and discharge roller 43. The conveyance control unit 50 mainly comprises the CPU 51 that controls the overall operation of the MFD 1, and the ASIC (Application Specific Integrated Circuit) 53 that controls the rotational speed and rotational direction of the motor 45.

Figure 4:
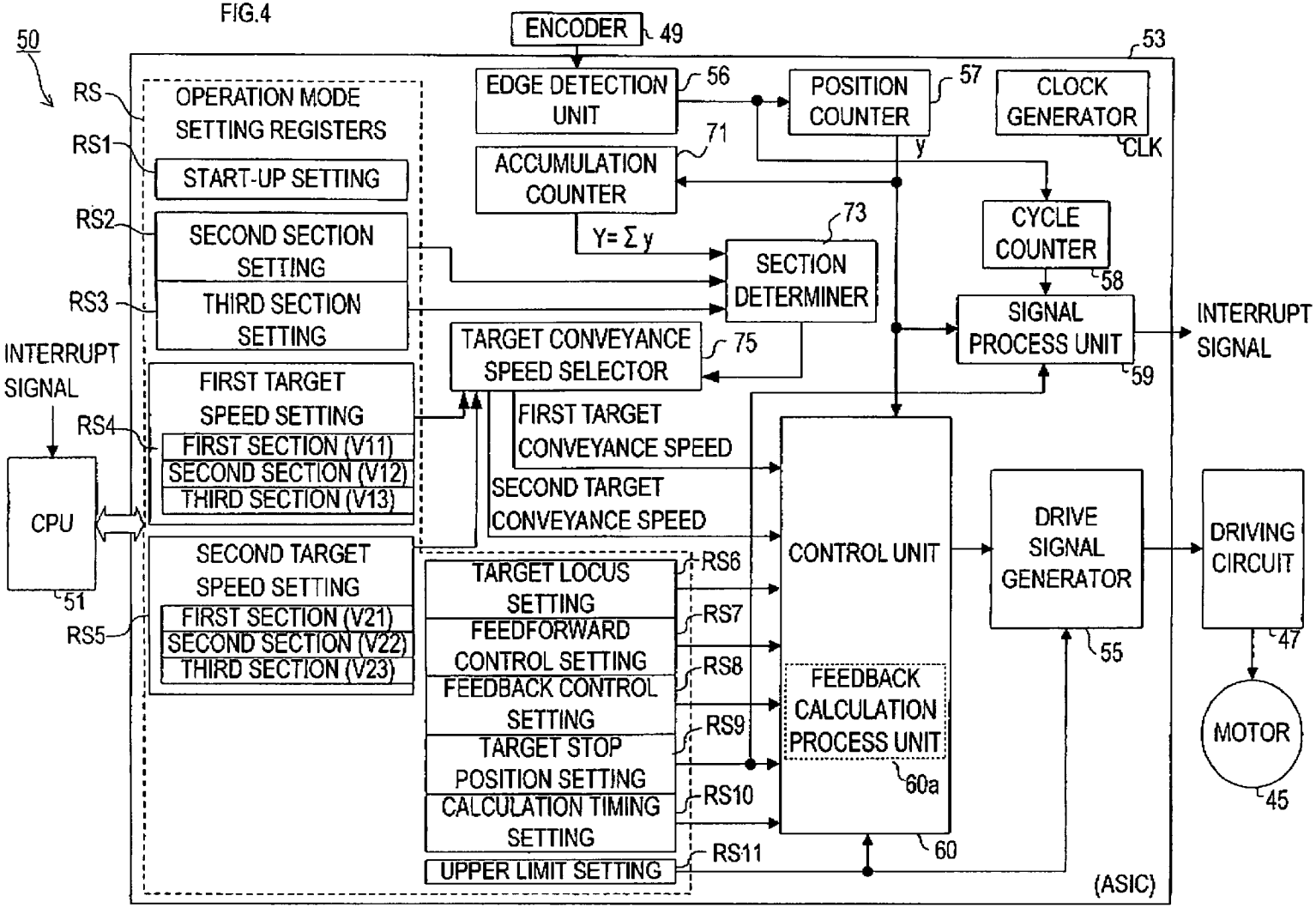
FIG. 4 is a block diagram to show the structure of the conveyance control unit of the embodiment.

FIG. 4 shows the structure of the conveyance control unit 50. The following only describes the control of paper conveyance during an image formation process (the main process). Thus, FIG. 4 shows only the constituents necessary for the motor control during the image formation process.

As described above, the paper conveyance during the image formation process is attained by paper P being sequentially conveyed for a predetermined distance in the sub-scanning direction (paper conveyance direction). Specifically, recording for one path of an image is conducted by the reciprocating recording head 15 in the main scanning direction. For further recording of subsequent paths, paper P is conveyed in the sub-scanning direction for a predetermined distance (conveyance distance Ds to convey paper P for one path that is the distance corresponding to the width of the image formation area RG in the conveyance direction shown in FIG. 3) and stopped. Subsequently, recording in the main scanning direction for the next path is conducted by the recording head 15. When this recording is finished, the paper P is still furthermore conveyed in the sub-scanning direction for the predetermined distance for recording the following path and stopped. Then, recording in the main scanning direction is conducted by the recording head 15. That is, paper conveyance for a predetermined distance in the sub-scanning direction is repeated until the recording on to paper P is completed.

In the following, first, the structure of the driving circuit 47, which receives various commands from a drive signal generator 55 provided in the ASIC 53 of the conveyance control unit 50, is described and then the structure of the conveyance control unit 50 (especially the ASIC 53) is described based on FIG. 4.

Figure 5A:
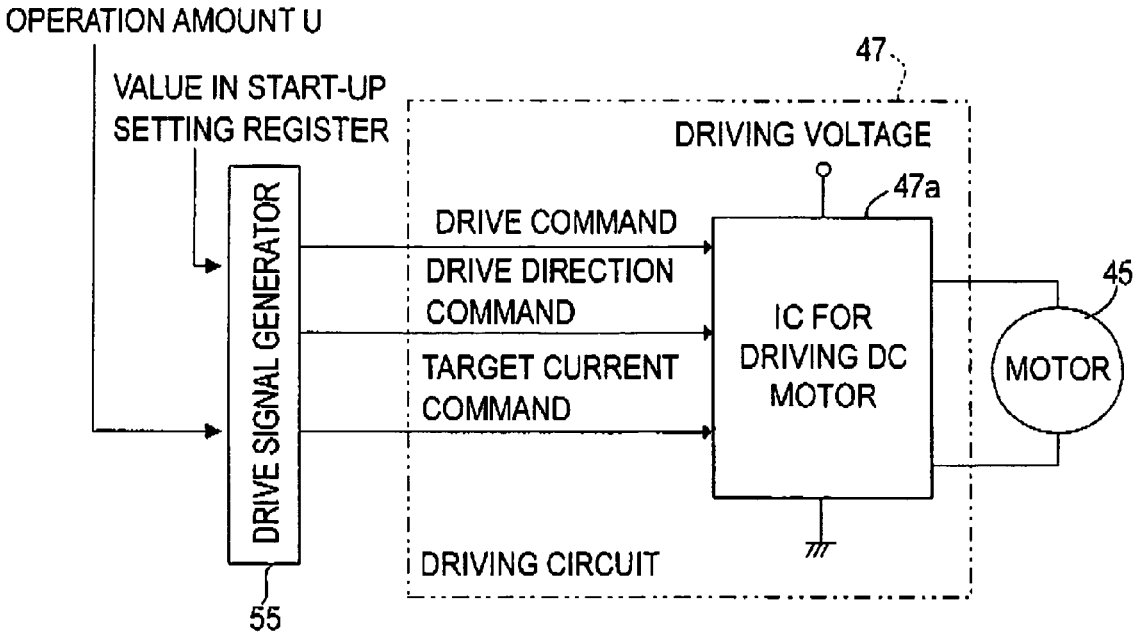
FIGS. 5A and 5B are explanatory views related to the structure of a driving circuit of the embodiment.
Figure 5B:
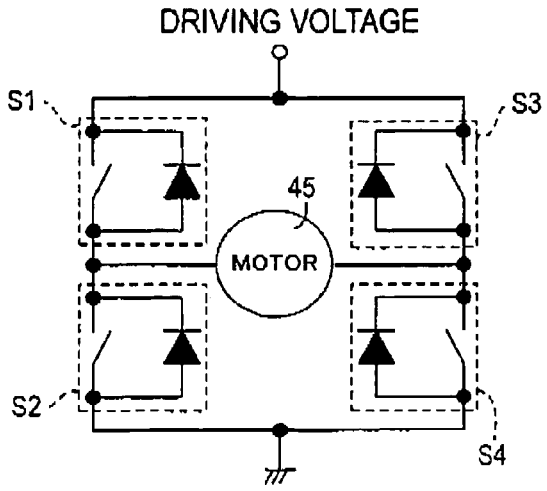

The structure of the driving circuit 47 is as shown in FIG. 5*a*. The driving circuit 47 starts the operation thereof upon receiving a drive command generated in the drive signal generator 55, and rotates the motor 45 in a driving direction (regular direction of the rotation of the motor 45) corresponding to a direction command from the drive signal generator 55. The rotation amount of the motor 45 is controlled based upon a target current command from the drive signal generator 55. More specifically, inside of IC 47*a* used for driving a DC motor, a H-bridge circuit is formed with switching elements (S1 to S4). The switching operation of each switching element (S1 to S4) is controlled based on a target current command from the drive signal generator 55. FIG. 5*b* shows an equivalent circuit of the IC 47*a* and the motor 45.

The drive signals generator 55 provided in the ASIC 53 provides the driving circuit 47 constituted as above with a drive command and a direction command, based on a preset value in the start-up setting register RS1. The drive signal generator 55 generates a target current command (control signal) based on an operation amount u (the target current value in the present embodiment) generated in the control unit 60 within the ASIC 53, and provides the command for the driving circuit 47.

Respective parts in the ASIC 53, such as the above-described drive signal generator 55, an encoder edge detection unit 66, a position counter 57, a cycle counter 58, a signal process unit 59, and the control unit 60, operate based on a clock signal with a cycle that is sufficiently shorter than the cycle of a pulse signal from the encoder 49 generated by a clock generator CLK of the ASIC 53.

The encoder edge detection unit 56 obtains pulse signals from the encoder 49 and detects edges of the pulse signals (for example, either or both of a leading edge or/and a trailing edge). The position counter 57 detects the rotation amount of the conveyance roller 41 as a count value y by counting the edges detected by the encoder edge detection unit 56.

The cycle counter 58 counts time (cycle length) between edges detected by the encoder edge detection unit 56. The signal process unit 59 conducts error handling and outputs interrupt signals to the CPU 51. The control unit 60 calculates an operation amount u to be inputted into the drive signal generator 55 based on various values of operation mode setting registers RS in the ASIC 53 and a count value y of the position counter 57, and conducts feedback control of the motor 45 for paper conveyance.

Figure 6:
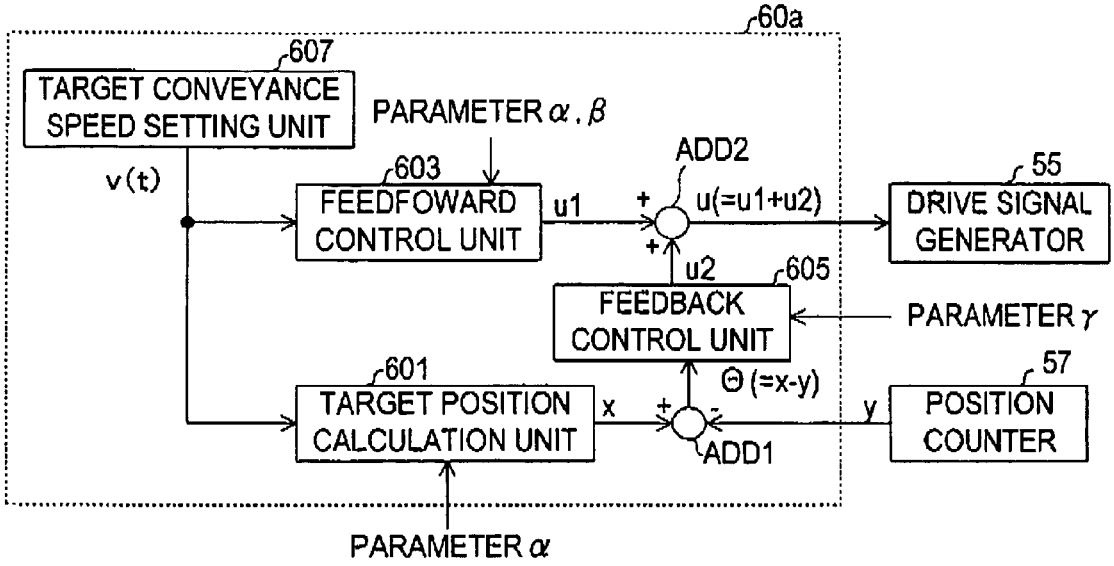
FIG. 6 is a block chart to show the structure of a feedback calculation process unit of the embodiment.

FIG. 6 shows a block diagram of the structure of a feedback calculation process unit 60*a* included in the control unit 60 of the ASIC 53. As shown in the drawing, the feedback calculation process unit 60*a* conducts feedback control so that the count value y of the pulse signals generated in the encoder 49 and obtained from the position counter 57 corresponds to a target position x calculated in a target position calculation unit 601. The feedback calculation process unit 60*a* comprises the target position calculation unit 601, a feedforward control unit 603, a feedback control unit 605, a target conveyance speed setting unit 607, a first adder ADD1 and a second adder ADD2.

The position counter 57 provided in the ASIC 53 is constituted to reset the count value y every time paper conveyance (the conveyance process) to convey paper P for one path is initiated. Consequently, the rotation amount of the conveyance roller 41 during conveyance control for one path can be obtained from the count value y in the position counter 57. The rotation amount of the conveyance roller 41 during the conveyance control for one path generally corresponds to the travel distance of paper P during the conveyance control for one path. Therefore, the count value y can be interpreted as a value indicating the conveyance distance (the conveyance position) of a point of reference in paper P from the conveyance start point GS. The reference point is initially located at the conveyance start point GS when the conveyance control for one path is started.

Figure 7A:
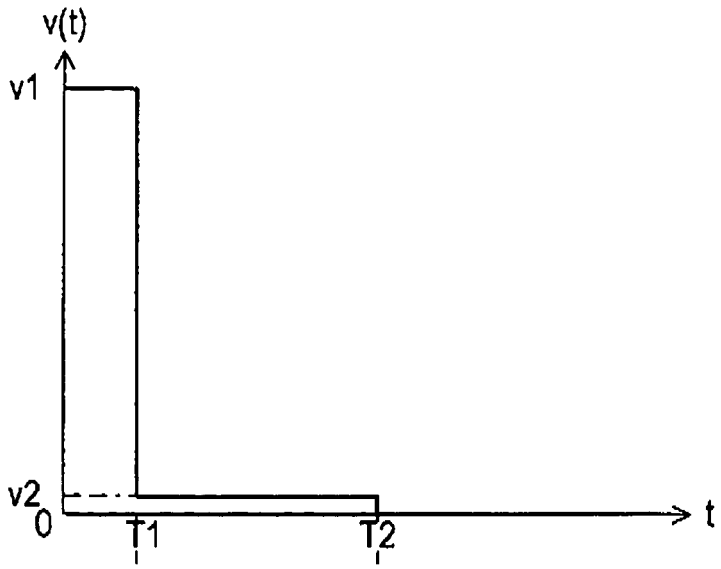
FIGS. 7A, 7B and 7C are graphs to show various responses produced when the motor is controlled by the feedback calculation process unit and the conveyance roller is operated.

The target conveyance speed setting unit 607 constituting the feedback calculation process unit 60*a* provides the target position calculation unit 601 and the feedforward control unit 603 with a target conveyance speed v (t) for conveyance control for one path into based on a first target conveyance speed v1 and a second target conveyance speed v2 (cf. FIG. 7*a*). The first target conveyance speed v1 is a target conveyance speed that should be attained between an initiation of conveyance and time T1 when predetermined time passes. The second target conveyance speed v2 is a target conveyance speed that should be attained between after the predetermined time and time T2 when conveyance for one path is finished. The variable t indicates time.

The target position calculation unit 601 sets the target position x (t) based on the above-described target conveyance speed v (t) every time calculation timing comes. The calculation timing is determined from a value of a calculation cycle Ts stored in a calculation timing setting register RS10. The target position x (t) indicates target rotation amount of the conveyance roller 41 and the discharge roller 43, and basically corresponds to the target conveyance position of paper P.

In a case in which the conveyance unit 40 operates according to a design value based on the target conveyance speed v (t) set in the target conveyance speed setting unit 607, at every calculation timing, the feedforward control unit 603 successively calculates an operation amount u1 (t) of the motor 45 in order to rotate the conveyance roller 41 and the discharge roller 43 so as to convey the paper P to the target position x (t), until the paper P is conveyed for a conveyance distance Ds and the conveyance (motor driving) is finished.

For example, when the relationship between the target conveyance speed v (t), and the target position x (t) calculated in the target position calculation unit 601, is expressed with a transfer function F1 (s), and the relationship between the operation amount u1 (t) and the rotation amount x (t), in case the conveyance unit 40 operates according to a design value, is expressed with a transfer function P (s), the operation amount u1 (t) is obtained in the feedforward control unit 603 with a transfer function F2 (s)=F1 (s)/P (s) using the target conveyance speed v (t).

In the ASIC 53, a target locus setting register RS6 is provided in order to store a value of parameter a, constituting an arithmetic expression for extracting the target position x (t)

from the target conveyance speed v (t). When the feedback calculation process unit 60*a* is operated, the value in the target locus setting register RS6 is extracted, and according to this value, transmission characteristics in the target position calculation unit 601 are determined.

Moreover, in the ASIC 53, a feedforward control setting register RS7 is provided in order to store a value of parameter a and B constituting an arithmetic expression for extracting the operation amount u1 (t) from the target conveyance speed v (t). When the feedback calculation process unit 60*a* is operated, the value in the feedforward control setting register RS7 is extracted, and according to this value, transmission characteristics in the feedforward control unit 603 are determined.

The above-described first adder ADD1 obtains an error Θ between the target position x (t), calculated in the above-described target position calculation unit 601, and the count value y in the position counter 57 from Θ=x·y, and provides this value Θ for the feedback control unit 605. The feedback control unit 605 calculates correction amount u2 (t) of an operation amount based on this error Θ calculated in the first adder ADD1, and provides the correction amount u2 (t) for the second adder ADD2. The transmission characteristics are determined, in the same way as in the above-described target position calculation unit 601 and the feedforward control unit 603, by a value in a feedback control setting register RS8 that stores the value of parameter r constituting a arithmetic expression for extracting the operation amount u2 (t) from the error Θ provided by the ASIC 53.

The second adder ADD2 adds the operation amount u1 (t), outputted from the feed forward control unit 663, and the operation amount u2 (t) outputted from the feedback control unit 605. Subsequently the second adder ADD2 generates the operation amount u (t), and provides the operation amount u (t) for the drive signal generator 55. The operation amount u (t) mentioned herein represents a target current value that should be applied to the motor 45. However, there is a limit to an attainable current value in the driving circuit 47. When the second adder ADD2 obtains an operation amount u that exceeds the upper limit set in the upper limit setting register RS11 of the ASIC 53, the feedback calculation process unit 60*a* sets the value of the upper limit for the operation amount u and outputs this value.

Conveyance control to convey paper P for one path is attained as described above. That is, conveyance for one path is controlled: first, by the operation amount u, calculated as above, being inputted into the drive signal generator 55; second, by the conveyance unit 40 being operated so as to attain the first target conveyance speed by the time T1 and to attain the second target conveyance speed by the time T2 based on this operation amount u; and then, paper P is conveyed for one path. In other words, a reference point of paper P located at the conveyance start point GS is conveyed to the image formation point GP.

Figure 7B:
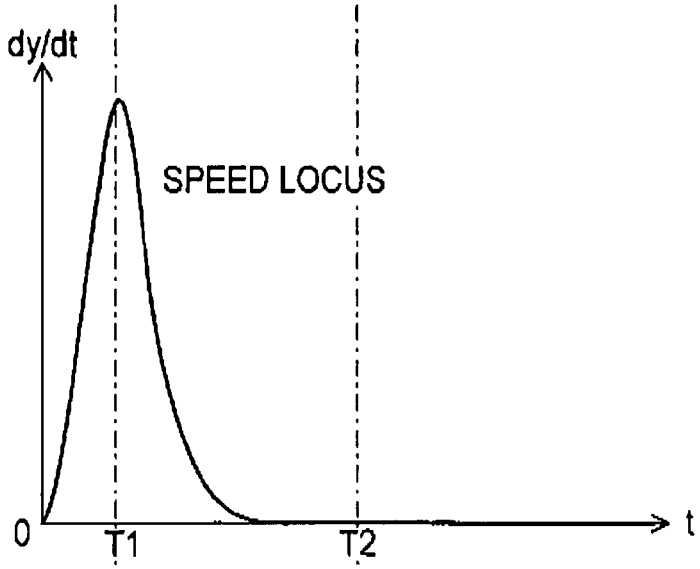
Figure 7C:
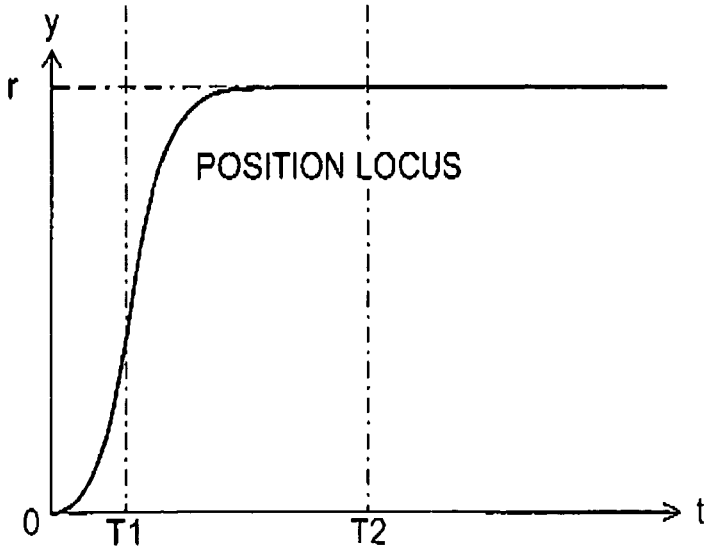
Figure 8:
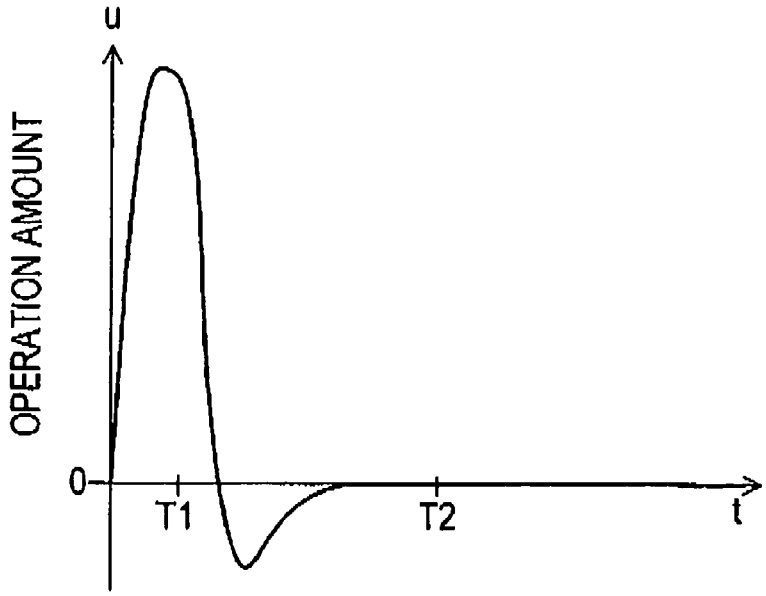
FIG. 8 is a graph to show the variation with time of the operation amount u.

The following describes various responses produced when the motor 45 is driven and the conveyance roller 41 is rotated by the feedback calculation process unit 60*a*. FIG. 7B is a graph showing the locus of the rotational speed of the conveyance roller 41 and the discharge roller 43 (conveyance speed of paper P) that is attained when the target conveyance speed v (t) shown in FIG. 7A is set. FIG. 7C is a graph showing the locus of the rotation amount of the conveyance roller 41 (the count value y in the position counter 57). FIG. 8 is a graph showing the variation with time of the operation amount u in the above-described status.

As shown in FIG. 8, when rotation of the motor 45 is initiated, the operation amount u (target current value) once increases in a positive direction, then changes toward the negative direction, and finally converges at an extremely small value in the vicinity of "0". Corresponding to the operation value u changing as above, the rotational amount of the conveyance roller 41 (more specifically, the count value y in the position counter 57) gradually increases and reaches a stop position r as shown in FIG. 7C. The rotational speed of the conveyance roller 41 once increases immediately after the rotation is initiated, and then gradually decreases to converge at "0" as shown in FIG. 7B.

In the MFD 1, the rear end of paper P (i.e. the end in the upstream side in the conveyance direction) remains in the U-turn path 11 during the image formation process. The load, applied to paper P during conveyance, changes immediately after the image formation process is initiated, wherein paper P is curved in the U-shape in the U-turn path 11, and immediately before the image formation process is finished, wherein the rear end of paper P passes the U-turn path 11 and the curved shape is reverted to the original state.

Moreover, in the MFD 1, conveyance of paper P is conducted with the rotational force of the conveyance roller 41 and the discharge roller 43 applied to paper P during the first half period of the image formation process. In the second half period of the image formation process, only the rotational force of the discharge roller 43 is applied to paper P so as to convey the paper P because the rear end of the paper P passes the contact point between the conveyance roller 41 and the pinch roller 42 in this period. After the rear end of paper P passes the contact point, the load, applied to the paper P by the conveyance roller 41 and the pinch roller 42 that are previously holding the paper P, is relieved. Therefore, the load applied to paper P changes in the first half period and in the second half period of the image formation process. Additionally, when the rear end of paper P passes the contact point with the conveyance roller 41 and the pinch roller 42, additional force is applied corresponding to the rotation of the conveyance roller 41, and paper P is flipped toward the downstream in the conveyance direction.

From the reasons described above, if the target conveyance speed is always set at a uniform speed when a conveyance control to convey paper P for one path is conducted a plurality of times and the image formation process is conducted, it is not possible, in the MFD 1, to accurately convey a reference point of paper P from the conveyance start point GS to the image formation point GP, and to accurately stop the reference point of the paper P at the image formation point GP.

Figure 9:
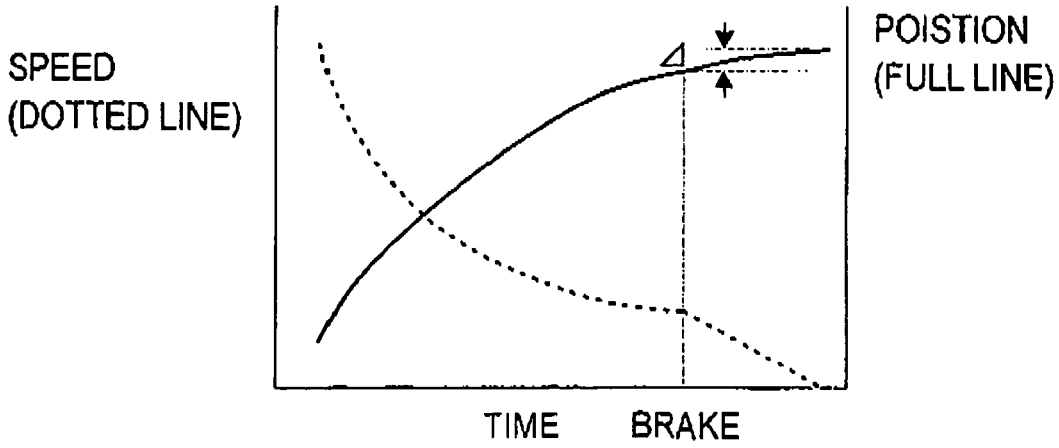
FIG. 9 is a graph to show the travel amount Δ caused by inertia.

In the MFD 1, paper P is conveyed at a high speed in order to maintain suitable speed for the image formation process. Even when the motor 45 is short-circuited to stop driving the conveyance roller 41, the discharge roller 43 and eventually paper P, the conveyance roller 41 and the discharge roller 43 do not stop immediately but slightly rotate by the influence of inertia. Correspondingly, paper P is slightly moved (travel distance Δ) by inertia toward the downstream in the conveyance direction as shown in FIG. 9.

The travel distance Δ of paper P changes depending on the rotational speed (the conveyance speed) of the motor 45 when the motor 45 is short-circuited, and depending on the amount of a load applied to the paper P. If the uniform target conveyance speed v (t) is set in the feedback calculation process unit 60*a* to conduct a control, when the amount of a load changes, the travel distance of paper P changes wherein the paper P moves from when conveyance is initiated until when the paper P actually stops. Therefore, a reference point of the paper P located at the conveyance start point GS cannot be accurately conveyed to the image formation point GP. FIG. 9 shows a graph indicating the travel distance Δ by the influence of inertia.

In order to solve this problem, the ASIC 53 of the MFD 1 comprises an accumulation counter 71, a section determiner 73, a target conveyance speed selector 75, a second section setting register RS2, a third section setting register RS3, a first target speed setting register RS4 that stores a preset value for the first target conveyance speed for each section, and a second target speed setting register RS5 that stores a preset value for the second target conveyance speed for each section.

The accumulation counter 71 counts the number of edge detection by the encoder edge detection unit 56 after the image formation process is initiated based on the count value y in the position counter 57, and outputs the number as count value Y.

The section determiner 73 determines a conveyance section of paper P, in which conveyance control for one path is conducted (a section in paper P to which a reference point of paper P located at the conveyance start point GS belongs), based on the count value Y in the accumulation counter 71, a value AR12 that is stored in the second section setting register RS2 and indicates the border between the first and second sections, and a value AR23 that is stored in the third section setting register RS3 and indicates the border between the second and third sections.

Figure 10A:
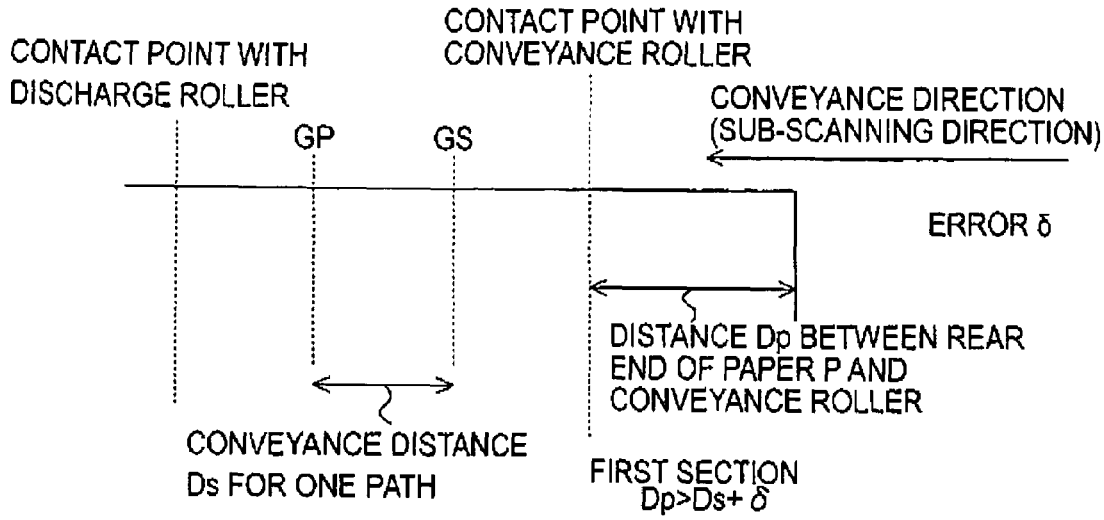
FIGS. 10A to 10C are explanatory views to describe how the first to third sections of paper are determined.
Figure 10B:
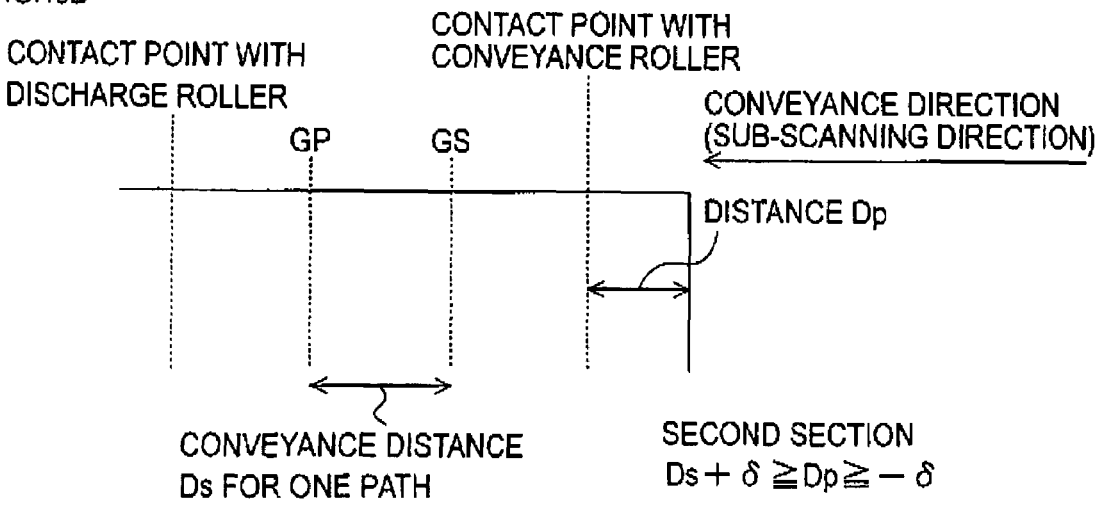
Figure 10C:
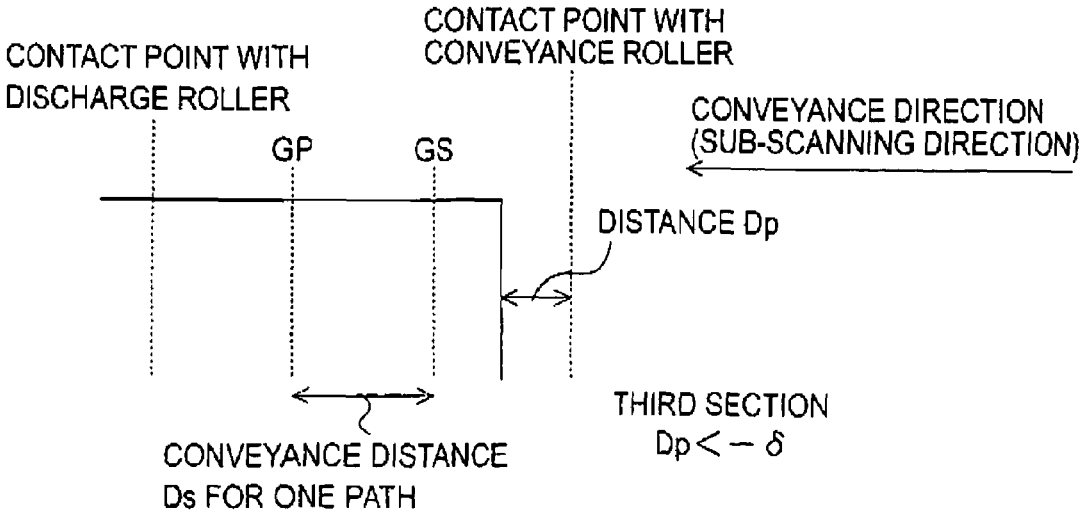

Specifically, in the present embodiment, paper P is sectioned as shown in FIGS. 10A to 10C, and the first to third sections are determined accordingly. The count value Y, that corresponds to the beginning point in the second section, is set in the second section setting register RS2. The count value Y, that corresponds to the beginning point in the third section, is set in the third section setting register RS3.

FIGS. 10A to 10C respectively show the first, second and third sections. The distance Dp shown in the drawings indicates the distance between the contact point of the conveyance roller 41 and the pinch roller 42 and the rear edge of paper P in the conveyance direction (the edge in the upstream side of the conveyance direction). When the rear edge of paper P is in the upstream side of the contact point, the distance Dp is positive. When the rear edge of paper P is in the downstream side of the contact point, the distance Dp is negative. In the present embodiment, a section of paper P, wherein the distance Dp becomes larger than the sum of the conveyance distance for one path Ds and an error δ (Ds+δ), is determined to be the first section. The error δ indicates the maximum error between the position of paper P, indicated by the count value Y in the accumulation counter 71, and the actual position of paper P. In the present embodiment, a section of paper P, wherein the driving force from the conveyance roller 41 is continuously applied during the conveyance control for one path, and wherein the rear end of paper P does not pass the contact point with the conveyance roller 41, is set as the first section.

The section of paper P, wherein the distance Dp between the contact point of the conveyance roller 41 and the pinch roller 42 and the rear end of paper P satisfies $Ds+\delta \geqq Dp \geqq -\delta$, is set to be the second section in the present embodiment. The count value Y in the accumulation counter 71, which corresponds to $Dp=Ds+\delta$, is set in the second section setting register RS2. In other words, in the present embodiment, the count value Y, which corresponds to L−Dp (Dp=Ds+δ) (L: the length of paper P in the conveyance direction), is set as the value AR12 that indicates the border between the first and the second sections. A section of paper P, wherein the driving force is applied to paper P at the contact point with the conveyance roller 41 when conveyance is initiated, and wherein there is a possibility that the rear end of paper P passes the contact point with the conveyance roller 41 in the middle of conveyance control for one path, is set as the second section.

The section of paper P, wherein the distance Dp between the contact point of the conveyance roller 41 and the pinch roller 42 and the rear end of paper P satisfies a relational expression $Dp<-\delta$, is set to be the third section. The count value Y in the accumulation counter 71, that corresponds to $Dp=-\delta$, is set in the third section setting register RS3 as the value AR23 that indicates the border between the second and the third sections. This third section is a section in paper P, wherein the driving force is continuously applied to paper P at the contact point with the discharge roller 43 during the conveyance control for one path, and wherein the driving force is not applied to paper P in the side of conveyance roller 41.

Based on a determination result of the section determiner 73, the target conveyance speed selector 75 of the present embodiment selects a value suitable for a section determined by the section determiner 73 among: the value v11 which is the value for the first target conveyance speed in the first section; the value v12 which is the value for the first target conveyance speed in the second section; and the value v13 which is the value for the first target conveyance speed in the third section. The values v11, v12 and v13 are stored in the first target speed setting register RS4. The target conveyance speed selector 75 provides a selected value for the control unit 60 as a setting value for the first target conveyance speed v1 for the feedback calculation process unit 60*a*.

The target conveyance speed selector 75 furthermore selects a value suitable for a section, determined by the section determiner 73, among: the value 21 that is the value for the second target conveyance speed in the first section; the value 22 that is the value for the second target conveyance speed for the second section; and the value v23 that is the value for the second target conveyance speed in the third section. The values v21, v22, and v23, are stored in the second target conveyance setting register RS5. One of these values is selected based on a determination result of the section determiner 73. The target conveyance speed selector 75 provides a selected value for the control unit 60 as a setting value for the second target conveyance speed v2 for the feedback calculation process unit 60*a*.

In the MFD 1 of the present embodiment, the first and second target conveyance speeds corresponding to a conveyance section of paper P is independently set in the feedback calculation process unit 60*a* by the operation of the target conveyance speed selector 75. Hence, in every conveyance control for one path (every paper conveyance for one path), the conveyance roller 41 and the discharge roller 43 are rotated at a rotational speed suitable for the section of paper P and convey paper P. Paper P is conveyed to the image formation point GP at a speed corresponding to the rotational speed of the conveyance roller 41 and the discharge roller 43 and corresponding to the section of the paper P.

In the image formation process, the load applied to paper P changes in the first half (in the first and second sections), wherein paper P is conveyed by the conveyance roller 41 and the discharge roller 43, and in the second half (in the third section), wherein paper P is driven only by the discharge roller 43. However, according to this MFD 1, it is possible to inhibit a change in the travel distance Δ by the influence of inertia, that is caused by the change in the load, and consequently to accurately stop a reference point of paper P at the image formation point GP.

As described above, when the rear end of paper P passes the contact point with the conveyance roller 41 and the pinch roller 42, paper P is flipped toward the downstream in the conveyance direction corresponding to the rotation of the conveyance roller 41. However, in the present embodiment, it is possible to convey a reference point of paper P and to accurately stop the reference point at the image formation point GP in the second section because the target conveyance speed is changed between the first and the second sections. Even without changing the target conveyance speed in every section, it could be possible to achieve conveyance control with high levels of accuracy by constantly conveying paper P at a low speed so as to make the travel distance Δ by the influence of inertia small. Yet, if the target conveyance speed is set in every section, as described in the present embodiment, paper P can be conveyed at a high speed in some section, wherein conveyance control can be accurately conducted with a high speed. Therefore, according to the present embodiment, it is possible to attain paper conveyance with high levels of accuracy and a high speed.

In the MFD 1 of the present embodiment, the target conveyance speed is changed when paper P is curved in the U-shape (in the first section) and when the rear end of paper P goes out of the U-turn path 11 and the curved shape is reverted (in the second and third section). Hence, it is possible to accurately convey a reference point of paper P to the image formation point GP irrespective of the change in the load during conveyance due to the deformation of paper P.

Since the preset values for the first target speed setting register RS4 and the second target speed register RS5 are determined in consideration of the characteristics of the mechanism and paper, specific values cannot be indicated here. However, for the present MFD 1, theses values can be set, for example, as shown in FIG. 11. FIG. 11 shows a chart indicating an example of settings of the first and the second target conveyance speeds in each section. The expressions "higher" and "lower" are used in FIG. 11 to be respectively compared with the first and second target conveyance speeds each set at uniform speed irrespective of the sections (reference speed).

As shown in FIG. 11, in the MFD 1, the first and the second target conveyance speeds for the first section may be set higher than the reference speed. The first and the second target conveyance speeds for the second section may be set lower. The first target conveyance speed for the third section may be set higher and the second target conveyance speed for the third section may be set lower. The setting for the target conveyance speed is not limited to the above-described combinations. It is also possible to set the first target conveyance speed lower, and the second target conveyance speed higher, depending on the characteristics of a device.

Figure 12:
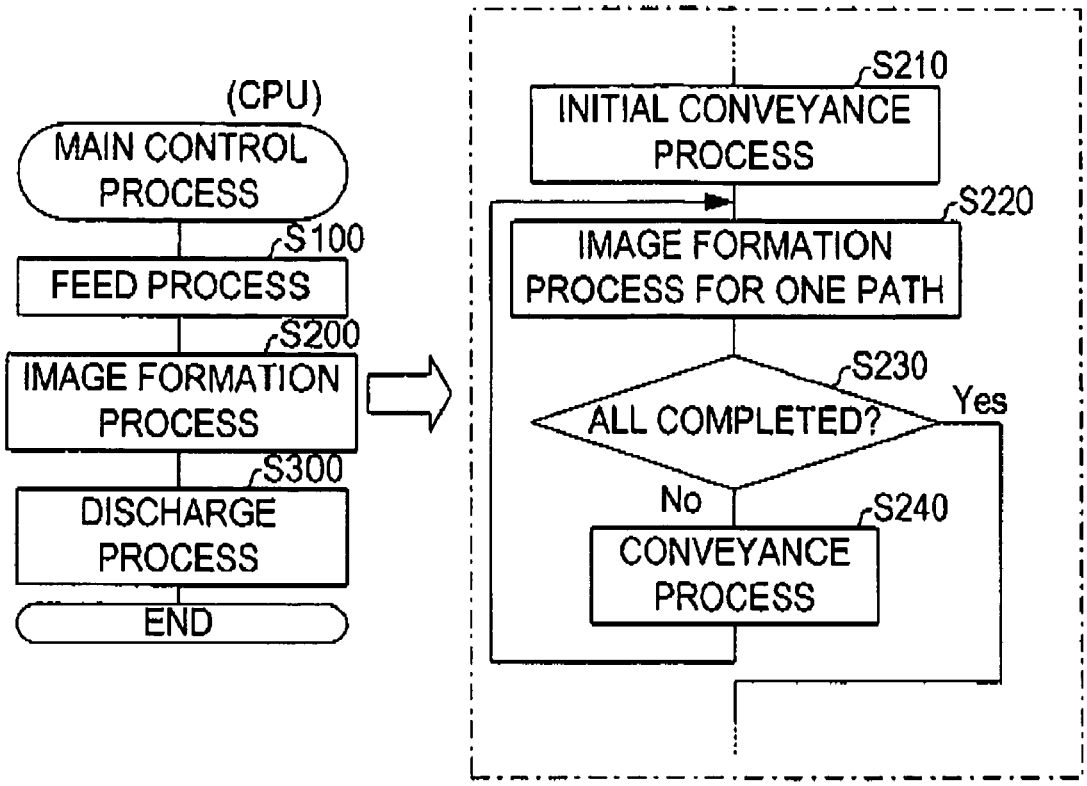
FIG. 12 is a flowchart to show a main control process conducted by the CPU.

The above has described the operation of the ASIC 53 in conveyance control so as to convey paper P for one path. In the present MFD 1, main control, such as feed process, image formation process, and discharge process, is conducted in the CPU 51. FIG. 12 shows a flowchart describing the main control processes that the CPU 51 conducts. The main control process is conducted by the CPU 51 when an image formation command is inputted into the CPU 51 from a personal computer (PC) connected to the MFD 1 or from the operation panel 29.

When the main control process is initiated, in S100, register setting in connection with feed operation is conducted on the ASIC 53 by the CPU 51. Consequently, in the ASIC 53, processes in connection with feed operation are conducted, and in the conveyance unit 40, the paper P is conveyed to the resist position (feed process). When this feed process is finished in S200, the image formation process is subsequently conducted.

When the image formation process is initiated, in S210 the initial conveyance process is conducted by the CPU 51 and based on control by the ASIC 53, the start point of the drawing area in paper P is conveyed to the image formation point GP. When this process is finished, in S220, the image formation process for one path of an image is conducted by the CPU 51. The image for one path is formed on the paper P by the carriage 17 moving in the main scanning direction, and ink being ejected from the recording head 15.

When this process is over, in S230, a determination is made by the CPU 51 as to whether or not image formation is finished up to the end point of paper P. When the CPU 51 determines that image formation is not yet finished (S230: NO), the process proceeds to S240 and the conveyance process is conducted by the CPU 51 (S240). A recording area for next path is conveyed to the image formation area RG (i.e. the reference point of paper P located at the conveyance start point GS is conveyed to the image formation point GP). Subsequently, the process goes back to S220 and the image formation process for another path is conducted.

On the other hand, when it is determined that image formation is finished up to the end point of the paper P (S230: YES), the process proceeds to S300 wherein the discharge process is conducted by the CPU 51 and, based on control by the ASIC 53, the paper P is discharged to the discharge unit 21.

Figure 13:
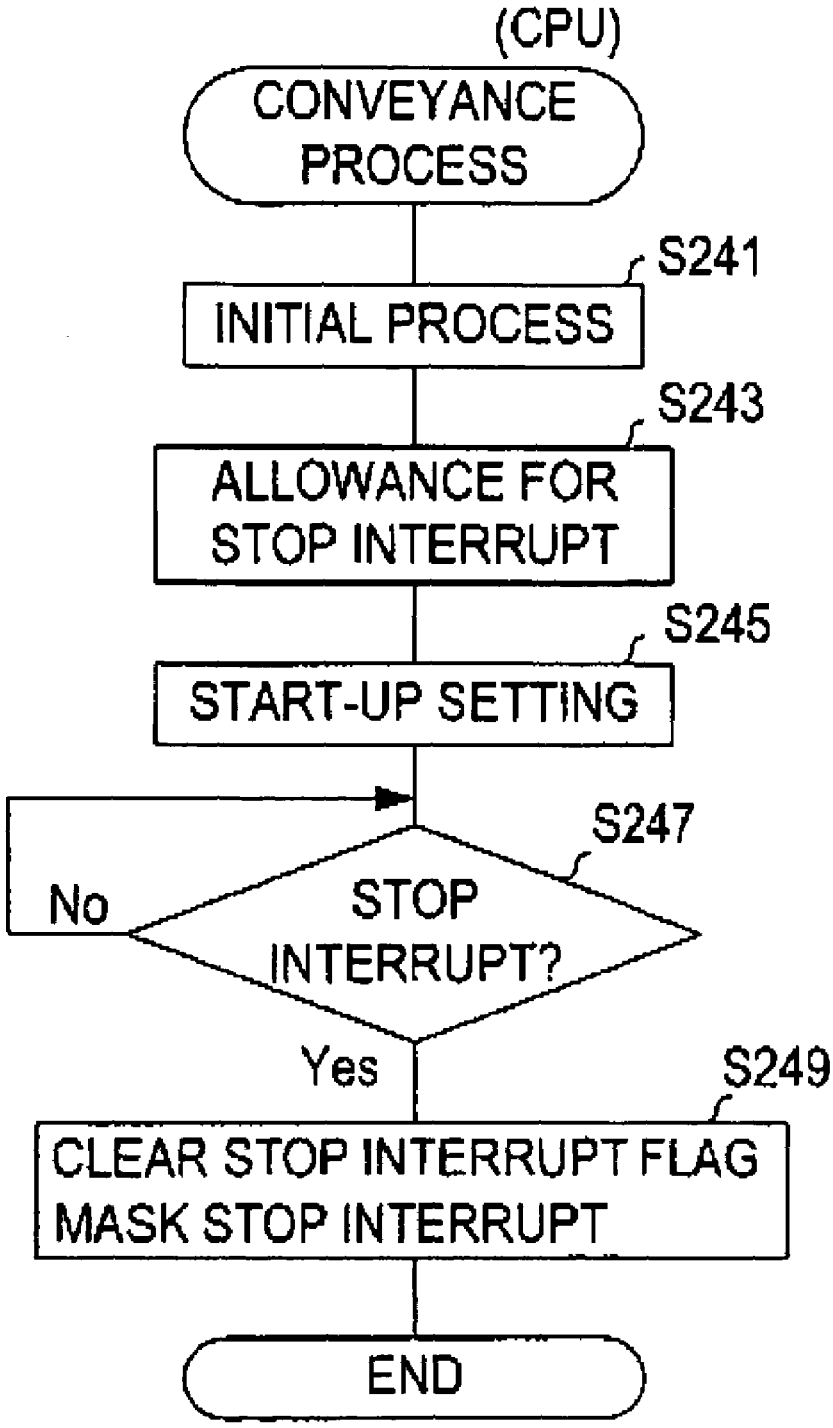
FIG. 13 is a flowchart to show a conveyance process conducted by the CPU.

FIG. 13 shows a flowchart describing the conveyance process conducted in S240. In S241 of the conveyance process, an initial process on the ASIC 53 is conducted (S241). In this initial process, setting is conducted for respective registers constituting the operation mode setting registers RS. When this process is finished, in S243 by an operation of the CPU 51, an allowance for stop interrupt is issued from the CPU 51 to the ASIC 53. As a result, the ASIC 53 becomes capable of outputting a stop interrupt signal.

Upon receiving the allowance for stop interrupt, the ASIC 53 detects, using the signal process unit 59, every status wherein paper P reaches the target stop position r set in the target stop position setting register RS 9 (i.e. every time the count value y in the position counter 57 becomes equal to or more than the value for the target stop position r), and provides a stop interrupt signal for the CPU 51. Even when the count value y in the position counter 57 does not go beyond the count value for the target stop position r, if the count value y in the position counter 57 does not change for certain period of time the ASIC 53 also provides a stop interrupt signal for the CPU 51. The target stop position r set in the target stop position setting register RS9 is a value corresponds with the conveyance distance Ds for one path.

Figure 16:
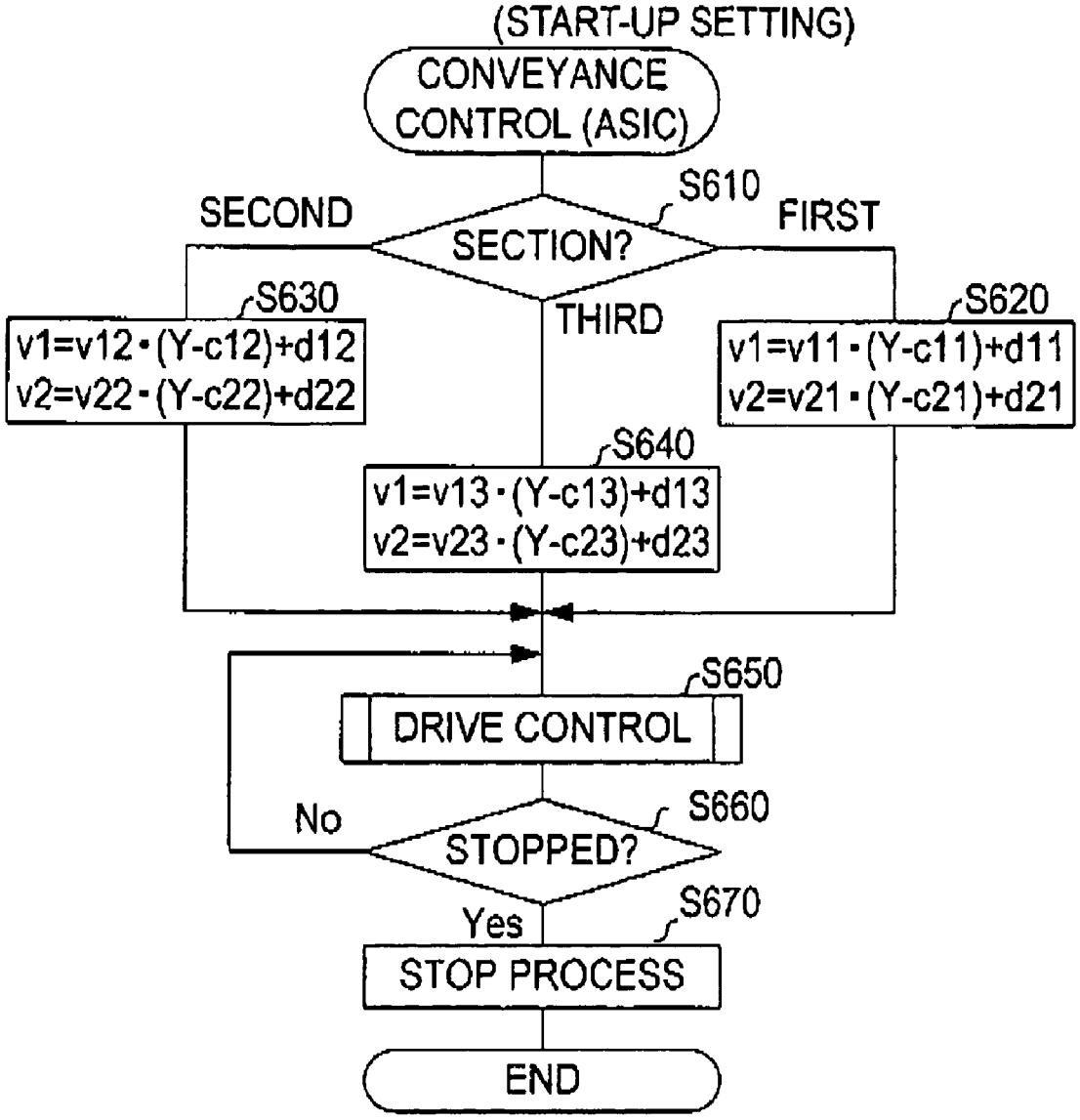
FIG. 16 is a flowchart to show a conveyance control process for one path conducted by the ASIC of the embodiment.

When the process in S243 is finished, in S245, start-up setting on the ASIC 53 is conducted by the CPU 51. That is, the setting in the start-up setting register RS1 by the CPU 51 triggers section determination, target conveyance speed selection and initiation of calculation for the operation amount u in the ASIC 53. The driving of the motor 45 and the corresponding paper conveyance for one path conducted by the rotation of the conveyance roller 41 and the discharge roller 43 are subsequently initiated. The motor control of the motor 45, initiated after the start-up setting (conveyance control for one path: c.f. FIG. 16), is basically conducted by the ASIC 53. The CPU 51 stands by, in S247, waiting for a stop interrupt signal.

When a stop interrupt signal is inputted from the ASIC 53, the CPU 51 clears the stop interrupt flag. Additionally, a masking process against the stop interrupt is conducted so as to block further stop interrupt signals. Subsequent to receipt of the interrupt signal, the process proceeds to S220 and the image formation process for one path is conducted by the CPU 51 as described above.

Figure 14:
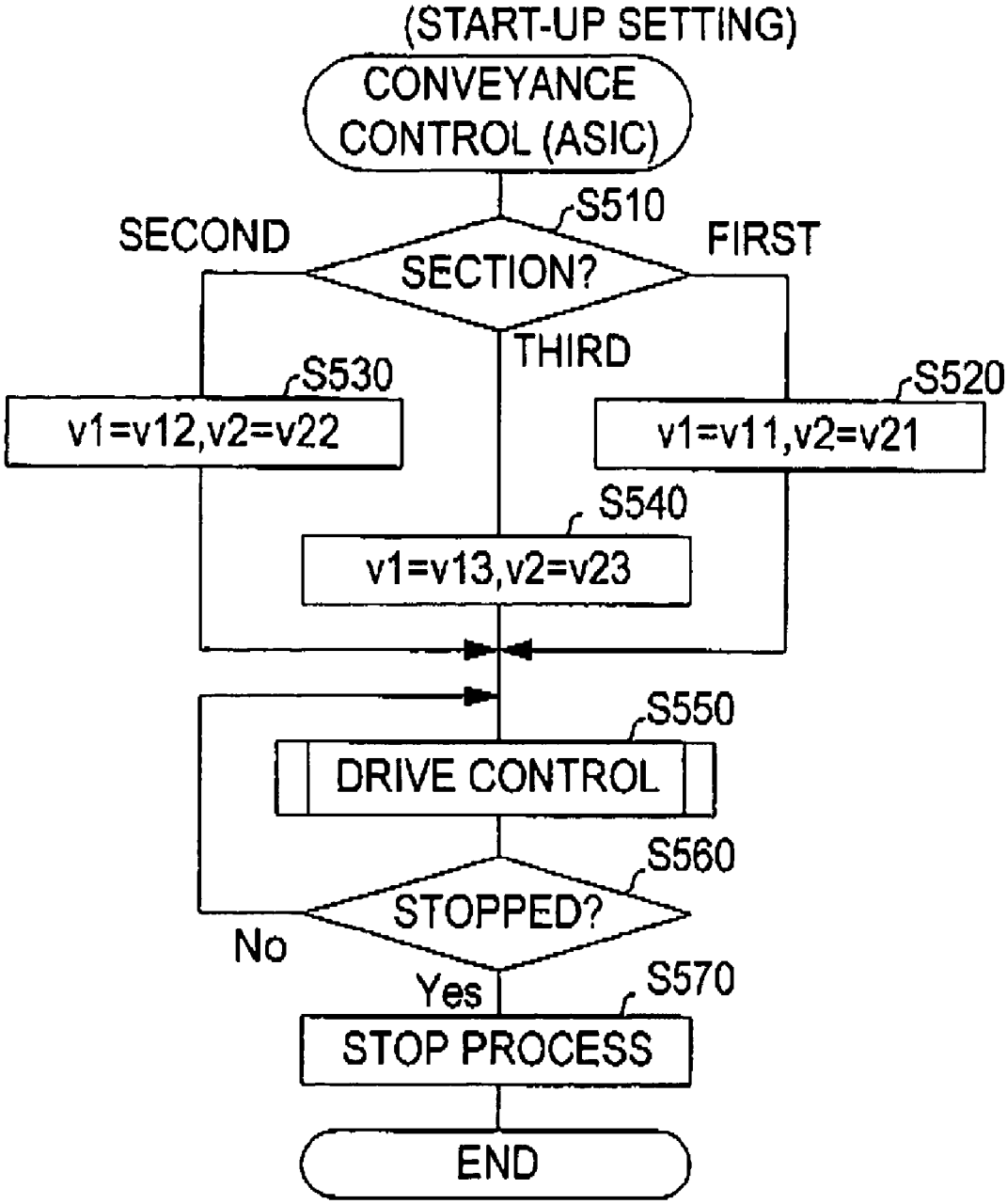
FIG. 14 is a flowchart to show a conveyance control process for one path conducted by the ASIC.

FIG. 14 is a flowchart describing the conveyance control process for one path conducted by the ASIC 53. Although motor control (conveyance control for one path) by the ASIC 53 is conducted as the operation of hardware as described above, the operation of hardware is put into a flowchart herein for description.

When the start-up setting is conducted and the conveyance control for one path is initiated, in S510, the ASIC 53 determines the conveyance section of paper P. Specifically, the section determiner 73 of the ASIC 53 is operated in this step. When the count value Y in the accumulation counter 71 is less than the value AR12 in the second section setting register RS2 (S510:FIRST), the section determiner 73 outputs a signal indicating the first section as a determination result. In S520, in the target conveyance speed selector 75, the value v11 for the first section, stored in the first target speed setting register RS4, is set for the first target conveyance speed v1, and the value v21 for the first section, stored in the second target speed setting register RS5, is set for the second target conveyance speed v2.

Alternatively, when the count value Y in the accumulation counter 71 is equal to or more than the value AR12 in the second section setting register RS2, and less than the value AR23 in the third section setting register RS3 (S510: SECOND), the section determiner 73 outputs a signal indicating the second section as a determination result. In S530, in the target conveyance speed selector 75, the value v12 for the second section, stored in the first target speed setting register RS4, is set for the first target conveyance speed v1, and the value v22 for the second section, stored in the second target speed setting register RS5, is set for the second target conveyance speed v2.

When the count value Y in the accumulation counter 71 is equal to or more than the value AR23 in the third section setting register RS3 (S510: THIRD), the section determiner 73 outputs a signal indicating the third section as a determination result. In S540, in the target conveyance speed selector 75, the value v13 for the third section, stored in the first target speed setting register RS4, is set for the first target conveyance speed v1, and the value v23 for the third section, stored in the second target speed setting register RS5, is set for the second target conveyance speed v2.

After these processes are conducted, in S550, the ASIC 53 initiates a driving control of the motor 45. Specifically, in this step, the feedback calculation process unit 60*a* is operated, and the target conveyance speed v (t) is determined based on the first target conveyance speed v1 and the second target conveyance speed v2 set by the target conveyance speed selector 75. The conveyance roller 41 and the discharge roller 43 are rotated at a speed for rotation amount corresponding to the determined target conveyance speed v (t), and paper P is conveyed at a speed corresponding to the rotational speed of these rollers. A calculation for obtaining the operation amount u conducted by the feedback calculation process unit 60*a* and a control of the motor 45, based on the calculation, is continued until conveyance for one path is finished and the motor 45 is short-circuited.

When the rotation of the motor 45 is braked and stopped after the motor 45 is short-circuited, the rotation amount of the conveyance roller 41 and the discharge roller 43 basically sets the target stop position r. In other words, paper P is moved for the conveyance distance Ds for one path, and a reference point of paper P, located at the conveyance start point GS prior to conveyance control, reaches the image formation point GP.

When the rotation of the conveyance roller 41 and the discharge roller 43 stops as well as the rotation of the motor 45 (S560: YES), the process proceeds to S570, and the ASIC 53 conducts the stop process. In this step, a stop interrupt signal is inputted into the CPU 51. Subsequently, the ASIC 53 finishes conveyance control for one path.

The above has described the structure of the MFD 1 of the present embodiment. In the MFD 1, the size and the type of paper P can be selected. For each size and type of paper, preset values in the second section setting register RS2, the third section setting register RS3, the first target speed setting register RS4, and the second target speed setting register RS5 can be switched for the image formation process conducted by the CPU 51. For this purpose, the above-described preset values for each paper size and paper type are stored in ROM (not shown) of the MFD 1.

Moreover, the above has shown an example of registering the values for the first and second target conveyance speed for each section into registers. In case the above-described sections are sectioned into smaller sections, it is possible to constitute the MFD 1 in a manner so that the first and second target conveyance speeds for each section can be obtained by a calculation based on the values in the registers (cf. Second Embodiment).

Second Embodiment

Figure 15:
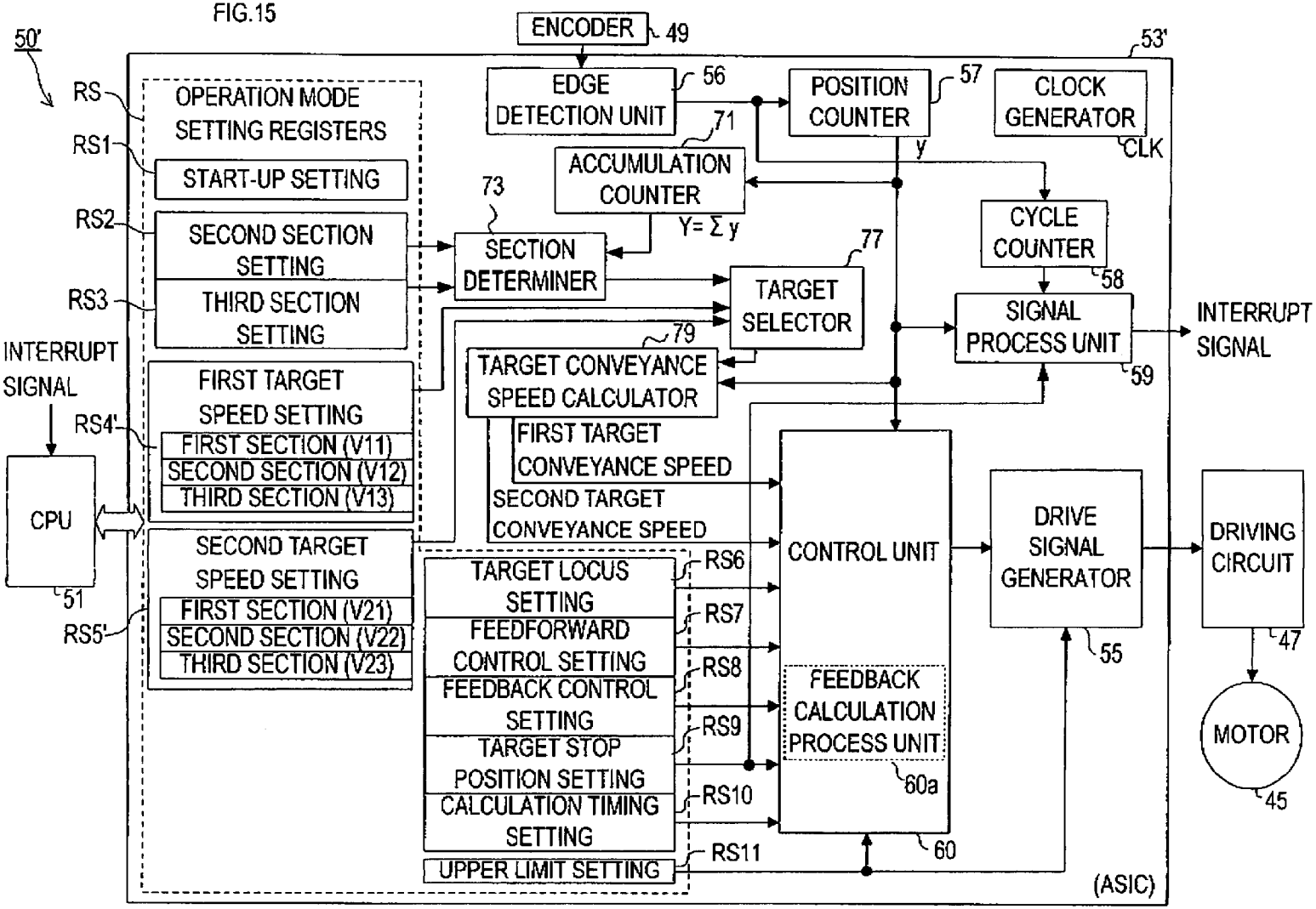
FIG. 15 is a block diagram to show the structure of a conveyance control unit of another embodiment.

FIG. 15 shows a block diagram illustrating the structure of a conveyance control unit 50' of another embodiment. FIG. 16 shows a flowchart describing the conveyance control process for one path conducted by ASIC 53' of the conveyance control unit 50'.

The ASIC 53' of the conveyance control unit 50' according to the present embodiment comprises a target selector 77 in place of the target conveyance speed selector 75 of the ASIC 53 shown in FIG. 4. The ASIC 53' additionally comprises a target conveyance speed calculator 79. There are some changes in the first and second target speed setting registers RS4' and RS5'.

The target conveyance speed calculator 79 of the ASIC 53' calculates the first target conveyance speed v1, that is to be set in the feedback calculation process unit 60*a* of the control unit 60, based each on the variations va1, c1, and d1, set in the target selector 77. The target conveyance speed calculator 79 provides the obtained first target conveyance speed v1 for the control unit 60. The target conveyance speed calculation 79 also calculates the second target conveyance speed v2, that is to be set in the feedback calculation process unit 60*a* of the control unit 60, based each on the variations va2, c2, and d2, set in the target selector 77. The target conveyance speed calculator 79 provides the obtained second target conveyance speed v2 for the control unit 60.

In order to set the first target conveyance speed, the target conveyance speed calculator 79 conducts a calculation according to an expression $v1=va1\cdot(Y\cdot c1)+d1$. To set the second target conveyance speed, the target conveyance speed calculator 79 conducts a calculation according to an expression $v2=va2\cdot(Y\cdot c2)+d2$. The variation Y is the count value Y in the accumulation counter 71.

The first target speed setting register RS4' stores values to be set as the variations (va1, c1, and d1) for each first to third section. Values va11, c11, and d11, are stored for the first section. Values va12, c12, and d12, are stored for the second section. Values va13, c13, and d13, are stored for the third section.

The second target speed setting register RS5' stores values to be set as the variations (va2, c2, and d2) for each first to third section. Values va21, c21, and d21, are stored for the first section. Values va22, c22, and d22, are stored for the second section. Values va23, c23, and d23, are stored for the third section.

When the section determiner 73 determines that the section of paper P under conveyance is the first section, the target selector 77 of the ASIC 53' sets the values (va11, c11, and d11) for the first section stored in the first target speed setting register RS4' for the variations (va1, c1, and d1). That is, va1=va11, c1=c11, and d1=d11. The target selector 77 also sets the values (va21, c21, and d21) for the first section stored in the second target speed setting register RS5' for the variations (va2, c2, and d2). That is, va2=va21, c2=c21, and d2=d21.

When the section determiner 73 determines that the section of paper P under conveyance is the second section, the target selector 77 sets the values (va12, c12, and d12) for the second section stored in the first target speed setting register RS4' for the variations (va1, c1, and d1). That is, va1=va12, c1=c12, and d1=d12. The target selector 77 also sets the values (va22, c22, and d22) for the second section stored in the second target speed setting register RS5' for the variations (va2, c2, and d2). That is, va2=va22, c2=c22, and d2=d22.

When the section determiner 73 determines that the section of paper P under conveyance is the third section, the target selector 77 sets the values (va1s, c13, and d13) for the third section stored in the first target speed setting register RS4' for the variations (va1, c1, and d1). That is, va1=va13, c1=c13, and d1=d13. The target selector 77 also sets the values (va23, c23, and d23) for the third section stored in the second target speed setting register RS 5 for the variation (va2, c2, and d2). That is, va2=va23, c2=c23, and d2=d23.

FIG. 16 shows a flowchart that describes the conveyance control process for one path conducted by the ASIC 53'. When this process is initiated, in S610, the ASIC 53' determines to which section of paper P the reference point belongs. Specifically, the section determiner 73 of the ASIC 53' is operated. When the count value Y in the accumulation counter 71 is less than the preset value AR12 in the second section setting register RS2 (S610: FIRST), the section determiner 73 outputs a signal indicating that the determination result is the first section. The process proceeds to S620, and in the target selector 77, va1=va11, c1=c11, d1=d11, va2=va21, c2=c21, and d2=d21, are set. In the target conveyance speed calculator 79, v1=va11·(Y·c11)+d11 is set for the first target conveyance speed, and v2=va21·(Y·c21)+d21 is set for the second target conveyance speed.

When the count value Y in the accumulation counter 71 is equal to or more than the preset value RA12 in the second section setting register RS2, but less than the preset value AR23 in the third section setting register RS3 (S610:SECOND), the section determiner 73 outputs a signal indicating that the determination result is the second section. The process proceeds to S630, and in the target selector 77, va1=va12, c1=c12, d1=d12, va2=va22, c2=c22, and d2=d22, are set. In the target conveyance speed calculator 79, va1=va12·(Y·c12)+d12 is set for the first target conveyance speed, and v2=va22·(Y·c22)+d22 is set for the second target conveyance speed.

When the count value Y in the accumulation counter 71 is equal to or more than the preset value AR2S3 in the third section setting register RS3 (S610:THIRD), the section determiner 73 outputs a signal indicating that the determination result is the third section. The process proceeds to S640, and in the target selector 77, va1=va13, c1=c13, d1=d13, va2=va23, c2=c23, and d2=d23, are set. In the target conveyance speed calculator 79, va1=va13·(Y·c13)+d13 is set for the first target conveyance speed, and v2=va23·(Y·c23)+d23 is set for the second target conveyance speed.

Subsequent to these steps, the process proceeds to S650, and the ASIC 53' initiates a control for driving the motor 45. In this step, the feedback calculation process unit 60*a* is operated and the target conveyance speed v (t), that is based on the first and the second target conveyance speeds v1 and v2 set by the target conveyance speed calculator 79, is set, and the conveyance roller 41 and the discharge roller 43 are rotated at the speed corresponding to the target conveyance speed v (t) for the rotational amount also corresponding to the target conveyance speed v (t). The calculation of the operation amount u by the feedback calculation process unit 60*a* and the control of the motor 45 based on the calculation are continued until conveyance for one path is finished and the motor 45 is short-circuited.

In S660, when the rotation of the conveyance roller 41 and the discharge roller 43 stop consequent upon the rotation of the motor 45 being stopped (S660:YES), the process proceeds to S670 and the ASIC 53' conducts the stop process. For the stop process, the ASIC 53' provides a stop interrupt signal for the CPU 51, and then finishes conveyance control for one path.

The above has described a variation of the structure of the conveyance control unit 50'. According to this variation, the target conveyance speed can be set more circumstantially as compared to the conveyance control unit 50. Therefore, the conveyance control unit 50' can circumstantially respond to the change in the load on paper P that occurs when paper P passes through the U-turn path 11. Moreover, the conveyance control unit 50' can more accurately convey a reference point of paper P located at the conveyance start point GS to the image formation point GP and stop paper P in every conveyance control.

The conveyance control device, the conveyance system and the image forming system of the present invention are not limit to the above-described embodiments. Variations and modifications are possible within the scope of the invention.

For example, the first and the second target conveyance speeds are switched for each section of paper P in the ASIC 53 or 53' in the above-described embodiments. It is also possible to provide a structure wherein the first and the second target conveyance speeds are switched by the CPU 51 that switches preset values for the first target speed setting register RS4 and the second target speed setting register RS5 for each section of paper P.

The conveyance control method of the present invention can be applied to paper feed operation, paper discharge operation and other type of conveyance systems.

In a conventional conveyance device wherein an object is conveyed by driving force being applied thereto, an object is still moved slightly toward the downstream side of a conveyance path by inertia even when the driving of the conveyance rollers is stopped. For this reason, in this type of conveyance device, the movement of an object toward the downstream of a conveyance path by inertia even after the driving of the conveyance rollers is stopped is already expected. Therefore, the conveyance device is controlled in a manner so that an object stops at a target point (conveyance destination).

In order to keep the travel distance of an object toward the downstream of a conveyance path through inertia short, a target conveyance speed is set in this type of conveyance control device. A feedback control is conducted so that this target conveyance speed is attained. Conveying an object at a low speed can surely make the travel distance of an object through inertia short. However, conveyance at a low speed reduces the performance of a conveyance device. Consequently, in this type of conveyance control device, the target conveyance speed is set relatively high when conveyance is initiated, and is set relatively low immediately before conveyance finishes so that inertia does not influence the result of conveyance.

Yet, there has been a problem in a conventional conveyance control wherein an object cannot be accurately conveyed to a conveyance destination depending on the structure of a conveyance path or the material of an object, because the travel distance of an object by inertia is expected to be uniform irrespective of a change in a load that is applied to an object so as to reflect the positional relationship between the object and a conveyance path, that guides the movement of an object. In other words, when an area of an object, wherein a large load is applied thereto, is conveyed to a conveyance destination, the object stops at a position more toward the upstream prior to the conveyance destination because the travel distance by inertia is smaller than the expected distance. On the other hand, when an area of an object, wherein a small load is applied thereto, is conveyed to the conveyance destination, the object stops at a position more toward the downstream further than the conveyance destination because the travel distance by inertia is larger than the expected distance.

In a case in which a conveyance path has several points of action, from which force is applied on an object by conveyance rollers, the force, applied to an object, changes depending on the positional relationship between the object and the conveyance path. Thus, according to a conventional conveyance control, an object, in some cases, cannot be accurately conveyed to a conveyance destination. For example, the amount of a load, applied on an object, decreases, and extra force, that flips the object toward the downstream, is applied when the edge of an object in the downstream side passes the points of action. In this kind of case, an object cannot be accurately conveyed to a conveyance destination.

According to the embodiments described above, the following effects can be attained. One of the effects is that a skill is provided wherein an object can be accurately conveyed to a conveyance destination. Another effect is that an image forming system is provided, wherein an image can be accurately formed at a predetermined position on an image forming medium, by using the above-described skill.

The above and other issues can be solved by a conveyance control device according to the above-described embodiments.

What is claimed is:

1. An image forming apparatus, which is provided with a first pair of rollers and a second pair of rollers along a conveyance path in such a manner that a recording medium, as an object to be conveyed, is conveyed by at least one of the first pair of rollers and the second pair of rollers, the image forming apparatus comprising:

a conveyance control device connected to a conveyance device that is operated according to a control signal inputted therein and conveys an object along a conveyance path by applying driving force corresponding to operation amount to the conveyance device conveying the object, the conveyance control device controls the conveyance device to convey the object, and comprises:

a detector that detects conveyance distance of the object;

a target setter that, before a start of a conveyance, sets a target conveyance speed for conveying the object from the start of conveyance to an end of conveyance;

an operation amount calculator that, based on a detection result of the detector, sequentially calculates the operation amount necessary for the conveyance device to convey the object to move the object from the start of conveyance to the end of conveyance at a speed corresponding to the target conveyance speed set by the target setter;

a conveyance controller that controls the conveyance device to convey the object by inputting a control signal corresponding to the operation amount calculated by the operation amount calculator into the conveyance device; and a position determiner that determines a position of the object before the start of the conveyance, wherein the target setter, before the start of the conveyance, sets the target conveyance speed corresponding to the position of the object determined by the position determiner, wherein a first target speed and a second target speed are predetermined, prior to conveyance of the recording medium, for:

(i) a first section where an edge in an upstream side of a conveyance direction of the recording medium does not pass between the first pair of rollers from the start of the conveyance to the end of conveyance of the recording medium;

(ii) a second section where the edge in the upstream side of the conveyance direction of the recording medium passes between the first pair of rollers from the start of conveyance to the end of conveyance of the recording medium; and (iii) a third section where the recording medium is conveyed by the second pair of rollers from the start of conveyance to the end of conveyance of the recording medium, and not conveyed by the first pair of rollers.

2. The conveyance control device as set forth in claim 1, further comprising an information storage that stores speed information indicating speed for the target conveyance speed for each of predetermined sections of the object, wherein a speed of a specific predetermined section of the object is set for the target conveyance speed when the position of the object belongs to the specific predetermined section, and wherein the target setter sets the target conveyance speed based on the speed information stored in the information storage and indicating the speed corresponding to the specific predetermined section.

3. The conveyance control device as set forth in claim 1, wherein the conveyance control device controls the conveyance device to repeat a process to convey the object from the start of the conveyance to the end of the conveyance, and to convey the object from a predetermined beginning point of the object initially located at the start of the conveyance to a predetermined end point of the object up to the end of the conveyance in predetermined interval, and wherein the conveyance control device operates the position determiner when the process is conducted.

4. The conveyance control device as set forth in claim 1, wherein the conveyance device has a point of action of driving force for the object respectively in an upstream side and a downstream side of the conveyance path, wherein a section determiner determines a section of the object to which the position of the object belongs between:

a first section wherein the driving force is applied to the object at the point of action in the upstream side when conveyance is initiated; and a second section wherein the driving force is applied to the object at the point of action in the downstream side when conveyance is initiated but not at the point of action in the upstream side.

5. A conveyance system comprising:

the conveyance control device as set forth in claim 4; and a conveyance device that is connected to the conveyance control device, is operated according to a control signal inputted from the conveyance control device, and conveys the object along the conveyance path from the upstream to the downstream of the conveyance path by applying driving force corresponding to operation amount of the conveyance device to the object, wherein the conveyance device comprises: pairs of rotators each having a rotational axis perpendicular to a conveyance direction and facing to each other along the conveyance path; and a driver that respectively rotates at least one of the pairs of rotators disposed in the upstream side and the downstream side, and wherein the pairs of rotators hold the object therebetween and apply the driving force corresponding to rotational amount that is the operation amount of the rotators to the object at a point of action that is a contact point of the rotators with the object.

6. An image forming system comprising:

the conveyance system as set forth in claim 5; and an image forming device that forms an image at the conveyance destination on the object conveyed by the conveyance system.

7. The conveyance control device as set forth in claim 1, wherein the conveyance device has a point of action of driving force for the object respectively in an upstream side and a downstream side of the conveyance path, and wherein a section determiner determines a section of the object to which the position of the object belongs between:

a non-transit section wherein an edge of the object in the upstream side does not transit the point of action in the upstream side during conveyance; and a transit section wherein there is a possibility that the edge of the object in the upstream side transits the point of action in the upstream side during conveyance.

8. A conveyance system comprising:

the conveyance control device as set forth in claim 1; and a conveyance device that is connected to the conveyance control device, is operated according to a control signal inputted from the conveyance control device, and conveys the object along the conveyance path from the upstream to the downstream of the conveyance path by applying driving force corresponding to operation amount of the conveyance device to the object, wherein the conveyance device comprises: at least one pair of rotators each having a rotational axis perpendicular to a conveyance direction and facing to each other along the conveyance path; and a driver that rotates at least one of the pair of rotator, and wherein the pair of rotators hold the object therebetween and apply the driving force corresponding to rotational amount that is the operation amount of the rotators to the object at a point of action that is a contact point of the rotators with the object.

9. An image forming system comprising:

the conveyance system as set forth in claim 8; and an image forming device that forms an image at the conveyance destination on the object conveyed by the conveyance system.

* * * * *

UNITED STATES PATENT AND TRADEMARK OFFICE

CERTIFICATE OF CORRECTION

PATENT NO. : 7,641,329 B2
APPLICATION NO. : 11/188724
DATED : January 5, 2010
INVENTOR(S) : Akiyama et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 450 days.

Signed and Sealed this

Sixteenth Day of November, 2010

David J. Kappos

David J. Kappos
*Director of the United States Patent and Trademark Office*